US010067467B2

(12) United States Patent
Wen et al.

(10) Patent No.: US 10,067,467 B2
(45) Date of Patent: Sep. 4, 2018

(54) CARTRIDGE MOUNTING MECHANISM AND PROCESS CARTRIDGE THEREOF

(71) Applicant: ZHONGSHAN KINGWAY IMAGE TECH CO., LTD., Zhongshan (CN)

(72) Inventors: Xueliang Wen, Zhongshan (CN); Junqing Liu, Zhongshan (CN)

(73) Assignee: ZHONGSHAN KINGWAY IMAGE TECH CO., LTD., Zhongshan (CN)

( * ) Notice: Subject to any disclaimer, the term of this patent is extended or adjusted under 35 U.S.C. 154(b) by 0 days.

(21) Appl. No.: 15/844,918

(22) Filed: Dec. 18, 2017

(65) Prior Publication Data

US 2018/0107156 A1 Apr. 19, 2018

Related U.S. Application Data

(63) Continuation of application No. 15/441,797, filed on Feb. 24, 2017, now Pat. No. 9,880,518, which is a continuation of application No. PCT/CN2016/101418, filed on Oct. 1, 2016.

(30) Foreign Application Priority Data

| | | |
|---|---|---|
| Feb. 26, 2016 | (CN) | 2016 1 0107281 |
| Jun. 21, 2016 | (CN) | 2016 1 0458508 |
| Aug. 10, 2016 | (CN) | 2016 1 0653067 |
| Nov. 23, 2016 | (CN) | 2016 1 1043676 |

(51) Int. Cl.
*G03G 21/18* (2006.01)

(52) U.S. Cl.
CPC ..... *G03G 21/1857* (2013.01); *G03G 21/186* (2013.01); *G03G 21/1842* (2013.01)

(58) Field of Classification Search
CPC ..... G03G 21/1857; G03G 21/1842; G03G 21/1853
See application file for complete search history.

(56) References Cited

U.S. PATENT DOCUMENTS

| | | | | |
|---|---|---|---|---|
| 9,026,006 | B2 * | 5/2015 | Kawai | G03G 15/50 192/82 R |
| 2005/0260010 | A1 * | 11/2005 | Yokota | G03G 21/186 399/111 |
| 2012/0275824 | A1 * | 11/2012 | Gu | G03G 21/186 399/111 |

(Continued)

FOREIGN PATENT DOCUMENTS

| | | |
|---|---|---|
| CN | 203882098 U | 10/2014 |
| CN | 203930340 U | 11/2014 |

(Continued)

*Primary Examiner* — Francis C Gray
(74) *Attorney, Agent, or Firm* — Anova Law Group, PLLC

(57) ABSTRACT

A process cartridge is provided. The process cartridge includes a housing, a rotation member rotatably mounted in the housing, and a support mounted on the housing. The rotation member includes a rotation unit and a drive unit coupled to the rotation unit. The drive unit further comprises a drive transmission device and an actuating rod coupled to the drive transmission device. The support includes a notch allowing the actuating rod to pass through. When the actuating rod receives an applied force, the actuating rod swings in a plane defined by a longitudinal direction and a horizontal direction of the process cartridge.

19 Claims, 11 Drawing Sheets

(56) References Cited

U.S. PATENT DOCUMENTS

| | | | | |
|---|---|---|---|---|
| 2013/0136492 | A1* | 5/2013 | Xu | G03G 21/186 399/111 |
| 2015/0177683 | A1* | 6/2015 | Gu | G03G 21/1857 399/111 |

FOREIGN PATENT DOCUMENTS

| | | | |
|---|---|---|---|
| CN | 105319933 | A | 2/2016 |
| CN | 105319934 | A | 2/2016 |
| CN | 205015614 | U | 2/2016 |
| CN | 106125531 | A | 11/2016 |
| JP | H11126009 | A | 5/1999 |

* cited by examiner

CARTRIDGE MOUNTING MECHANISM AND PROCESS CARTRIDGE THEREOF

CROSS-REFERENCES TO RELATED APPLICATIONS

This application is a continuation of U.S. patent application Ser. No. 15/441,797, filed on Feb. 24, 2017, which claims priority of Chinese Patent Application No. 201611043676.4, filed on Nov. 23, 2016, and of International Patent Application No. PCT/CN2016/101418, filed on Oct. 1, 2016, which claims priority of Chinese Patent Application No. 201610107281.X, filed on Feb. 26, 2016, Chinese Patent Application No. 201610458508.5, filed on Jun. 21, 2016, and Chinese Patent Application No. 201610653067.4, filed on Aug. 10, 2016, the entire contents of all of which are hereby incorporated by reference.

FIELD OF THE DISCLOSURE

The present disclosure generally relates to the field of electrophotogaphic imaging and, more particularly, relates to a process cartridge detachably mounted in an electrophotographic imaging apparatus.

BACKGROUND

Electrophotographic imaging apparatus (hereinafter referred to as "apparatus") is one of the apparatuses indispensable in a modern office environment. Common apparatuses include laser printer, laser copier, etc. Both the laser printer and laser copier utilize a laser beam loaded with objective information to scan the surface of a photosensitive member, thereby forming an electrostatic latent image on the surface of the photosensitive member. Further, the developer is applied to develop the electrostatic latent image, and via the transfer device inside the apparatus, the developed electrostatic latent image is eventually transferred to a medium material, thereby completing the imaging process.

The above-described developer is often accommodated in a process cartridge detachably mounted in the apparatus. As a rotation member, the above-described photosensitive member may be mounted inside the apparatus, or mounted in the process cartridge.

Using the above-described laser printer and the photosensitive member mounted in the process cartridge as an example, the photosensitive member may include a photosensitive cylinder coated with a photosensitive material on the surface, and a drive transmission device mounted at an end of the photosensitive cylinder. The drive transmission device receives a driving force from inside of the laser printer and transmits the received driving force to the photosensitive member, thereby driving the photosensitive member to rotate and work.

One of the existing drive transmission device includes a gear portion fixedly mounted at an end of the photosensitive cylinder, and a drive receiving member mounted inside the gear portion that swings freely. One end of the drive receiving member is a sphere, and the drive receiving member is coupled to the gear portion via a pin. Another end of the drive receiving member receives the driving force from inside of the laser printer and transmits the driving force to the gear portion via the pin, thereby driving the photosensitive cylinder to rotate.

Because one end of the drive receiving member mounted in the gear portion is a sphere, the rotation axis of the drive receiving member may be deflected freely with respect to the rotation axis of the photosensitive cylinder. That is, the rotation axis of the drive receiving member and the rotation axis of the photosensitive cylinder may be coaxial, or may show a certain inclination angle.

As described above, the existing drive receiving member may swing freely inside the gear portion, indicating that the sphere of the drive receiving member is not tightly fitted to the gear portion. For example, when the process cartridge or the rotation member is in transit, the drive receiving member may disengage with the gear portion. Thus, the drive transmission device may overall become ineffective, rendering an unfavorable situation where the end users cannot use the process cartridge. Accordingly, the existing drive transmission device or even the existing process cartridge need to be further improved.

BRIEF SUMMARY OF THE DISCLOSURE

One aspect of the present disclosure provides a process cartridge. The process cartridge includes a housing, a rotation member rotatably mounted in the housing, and a support mounted on the housing. The rotation member includes a rotation unit and a drive unit coupled to the rotation unit. The drive unit further comprises a drive transmission device and an actuating rod coupled to the drive transmission device. The support includes a notch allowing the actuating rod to pass through. When the actuating rod receives an applied force, the actuating rod swings in a plane defined by a longitudinal direction and a horizontal direction of the process cartridge.

Other aspects of the present disclosure can be understood by those skilled in the art in light of the description, the claims, and the drawings of the present disclosure.

BRIEF DESCRIPTION OF THE DRAWINGS

Other features, goals and advantages of the present disclosure will become more apparent from a reading of the following detailed description of non-limiting embodiments with reference to the accompanying drawings.

FIG. 3 illustrates a schematic view of an overall structure of an actuating rod according to embodiments of the present disclosure;

DETAILED DESCRIPTION

The present disclosure will now be described in more detail hereinafter with reference to the accompanying drawings and embodiments. It should be understood that, the exemplary embodiments described herein are for illustrative purpose only, and are not intended to limit the present disclosure. In addition, it should be noted that, for ease of description, the accompanying drawings merely illustrate a part of, but not all structures related to the present disclosure.

Figure 1:
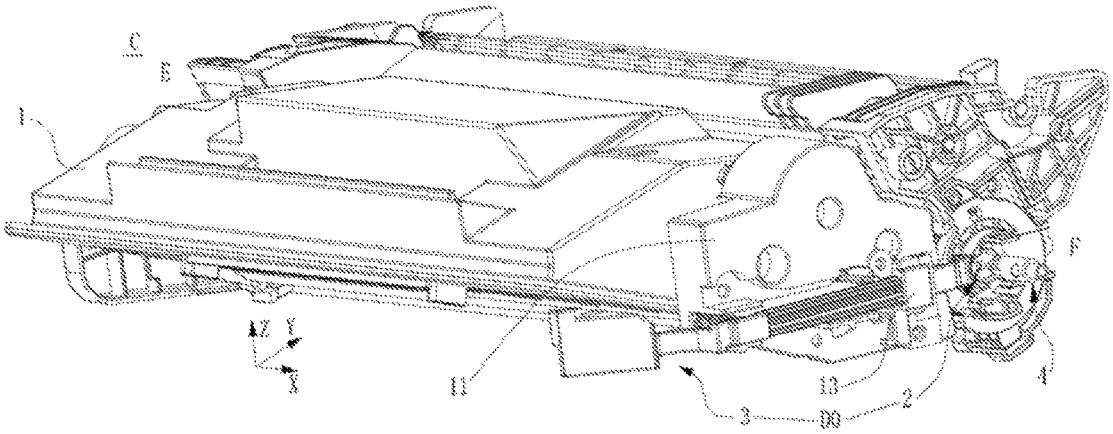
FIG. 1 illustrates a schematic view of an overall structure of a process cartridge according to embodiments of the present disclosure.

FIG. 1 illustrates a schematic view of an overall structure of a process cartridge according to embodiments of the present disclosure. As shown in FIG. 1, the length direction of a process cartridge C is defined as a longitudinal direction X. The mounting direction of the process cartridge C is defined as a lateral direction Y, and the direction perpendicular to the longitudinal direction X and the lateral direction Y is defined as a vertical direction Z. Hereinafter, the longitudinal direction, the lateral direction, and the vertical direction are consistent with the definitions described herein.

Along the longitudinal direction X, the process cartridge C has two ends: a conducting end E and a driving end F. After the process cartridge C is mounted to an electrophotographic imaging apparatus (hereinafter referred to as "apparatus"), the conducting end E may contact a conductive contact point in the apparatus to receive electric energy, and the driving end F may be coupled to a drive output member 4 (to be described in detail with reference to FIG. 2) to receive a driving force.

The process cartridge C comprises a process cartridge housing 1, and a rotation member (not shown) rotatably mounted in the process cartridge housing 1. The process cartridge housing 1 comprises an end cap 11 configured to support and protect the gem set in the process cartridge C, and a protecting cover 13. More specifically, the end cap 11 may be mounted at the driving end F of the process cartridge C, and the protecting cover 13 may be mounted onto the end cap 11.

Further, the rotation member has a rotation axis L1 (not shown) and comprises a rotation unit and a drive unit D0 connected to the rotation unit. The drive unit D0 may be detachably mounted at a longitudinal end of the rotation unit. More specifically, the drive unit D0 may be located at the driving end F of the processor cartridge C.

The drive unit D0 may comprise a drive transmission device 2 and an actuating rod 3 coupled to the drive transmission device 2. The drive transmission device 2 may be fixedly mounted at a longitudinal end (e.g., the driving end F) of the rotation unit. That is, the drive transmission device 2 may be on the same side as the end cap 11. The actuating rod 3 is mounted on the housing 1, and more specifically, mounted onto the end cap 11.

When the process cartridge C mounted with the drive transmission device 2 and the actuating rod 3 is itself mounted to the apparatus and an external force is applied on the actuating rod 3, the actuating rod 3 may swing between a free position and an operating position in a plane defined by the longitudinal direction X and the lateral direction Y. As the actuating rod 3 swings, the drive transmission device 2 may engage and disengage with the drive output member 4 (to be described hereinafter) configured in the apparatus.

Figure 2:
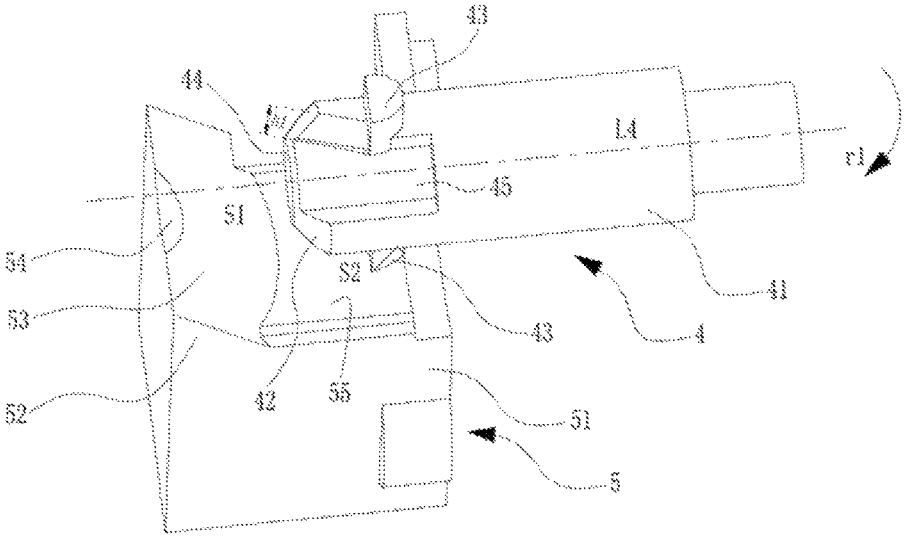
FIG. 2 illustrates a structural schematic view of a drive output device in an apparatus according to embodiments of the present disclosure.

FIG. 2 illustrates a structural schematic view of a drive output device in an apparatus according to embodiments of the present disclosure. The drive output device comprises a drive output member 4 and a guiding member 5 ranged in a spaced apart relationship.

The drive output member 4 may comprise a driving shaft 41 showing an overall cylindrical shape, a taper portion 42 located at an end of the driving shaft 41 close to the guiding member 5, and a drive output lever 43 extending outwardly along a radical direction of the driving shaft 41. The drive output member 4 may further comprise an end surface 44 of the driving shaft 41 located at a free end of the taper portion 42, and a concave portion 45 extending from the end surface 44 in a direction facing away the end surface 44 along a rotation axis L4 of the driving shaft 41.

More specifically, the drive output lever 43 is configured close to the end of the driving shaft 41 whom the taper portion 42 is located. The end surface 44 is located at an end of the driving shaft 41 close to the guiding member 5. Along the rotation axis L4, the concave portion 45 extends to exceed the drive output level 43.

In one embodiment, two drive output levers 43 may be configured, and the two drive output levers 43 may be located at opposite positions along a radical direction of the driving shaft 41. Further, as shown in FIG. 2, along the radical direction of the driving shaft 41, a concave depth of the concave portion 45 is h1.

Further, the drive output member 4 is connected to a motor inside the apparatus, thereby receiving a driving force outputted by the motor. The drive output member 4 may rotate around the rotation axis L4 in a direction denoted by r1. Simultaneously, an end of the driving shaft 41 opposite to the end surface 44 is connected to a spring (not shown).

When the end surface 44 receives a force applied in a direction from the end surface 44 to the drive output lever 43 along the rotation axis L4, the driving shall 41 compresses the spring. After the applied force is removed, the driving shaft 41 moves in an opposite direction (i.e., a direction from the drive output lever 43 to the end surface 44 along the rotation axis L4) under the effect of the restoring force of the spring. Accordingly, the driving shaft 41 has a certain extension and retraction amount in the direction of the rotation axis L4.

Further, as shown in FIG. 2, the guiding member 5 comprises a base 51 and a guiding member protrusion 52 extending from one side of the base 51. The guiding member 5 further comprises a thrust surface 53 located on top of the guiding member protrusion 52 facing towards the end surface 44, a thrust groove 54 configured in the guiding member protrusion 52, and a base top surface 55 located on the base 51 facing towards the driving shaft 41. The thrust surface 53 is an inclined plane. Further, the thrust groove 54 is recessed in a direction from a top end of the protrusion 52 to the base 51 and intersects with the thrust surface 53.

As described above, the drive output member 4 and the guiding member 5 are arranged in a spaced apart relationship. Based on the relative positions of the drive output member 4 and the guiding member 5, when the drive output member 4 is in a natural condition, a space formed between the guiding member 5 and the end surface 44 is defined as a first space S1, and a space formed between the base top surface 55 and the driving shaft 41 is defined as a second space S2. When the driving shaft 41 rotates, the drive output lever 43 may pass through the second space S2.

Figure 3:
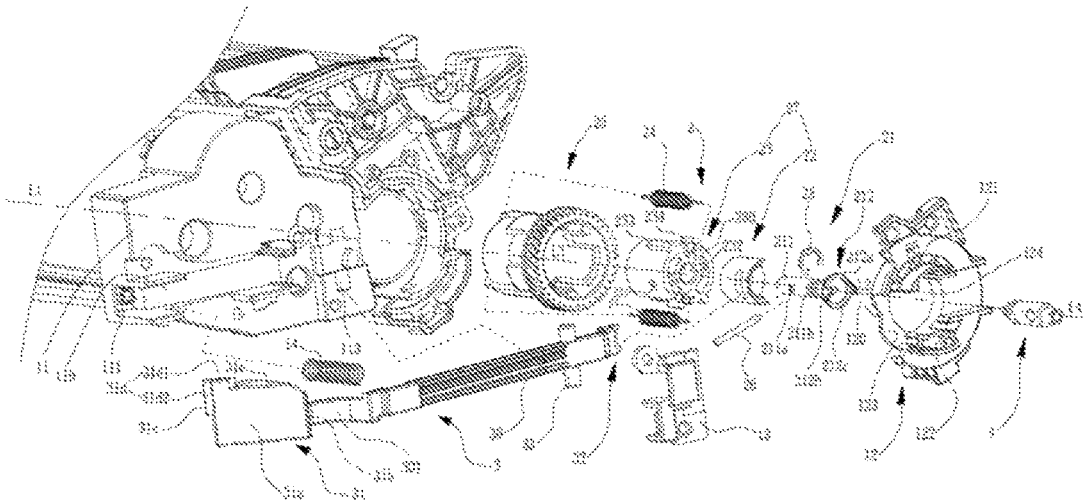
FIG. 3 illustrates an exploded schematic view of a process cartridge according to embodiments of the present disclosure.

FIG. 3 illustrates an exploded schematic view of the process cartridge C according to embodiments of the present disclosure. As shown in FIG. 3, other than aforementioned drive transmission device 2, end cap 11, and actuating rod 3, etc., the process cartridge C may further comprise a support 12 mounted on the process cartridge housing 1 and configured to support the rotation member. More specifically, the support 12 may comprise a notch 120 having a notch bottom surface 123, a first lug 121, a second lug 122, and a third through-hole 124. The notch 120 may be configured to allow the actuating rod 3 to pass through, thereby simplifying the structure of the process cartridge C.

Optionally, the process cartridge C may further comprise an auxiliary resetting member 14 configured to allow the process cartridge C to operate more stably. The auxiliary resetting member 14 may be, for example, a spring.

Further, referring to FIG. 3, the aforementioned drive transmission device 2 may specifically comprise a drive receiving member 21, a resetting member 24, a gear portion 25, a connecting pin 26, and a connecting member 27 including a middle member 22 and a supporting member 23. The drive receiving member 21 may be connected to the connecting member 27, and further comprise a first portion 211 and a second portion 212. Optionally, the supporting member 23 may further include a supporting desk 230, a third connecting hole 231, a supporting hole 232, a drive transmission portion 233, and a protrusion portion 234.

Optionally, the first portion 211 of the drive receiving member 21 may include a first connecting hole 211*a* and a clamping groove 211*b*. Optionally, the second portion 212 of the drive receiving member 21 may include a supporting portion 212*a*, a drive receiving portion 211*b*, and an inlet port 212*c*.

Further, referring to FIG. 3, the aforementioned end cap 11 may further comprise a guiding groove 110 configured to guide the actuating rod 3. The guiding groove 110 may further comprise a convex column 111, and the convex column 11 may be coupled to one end of the auxiliary resetting member 14. Optionally, the end cap 11 may further comprise a rotation groove 113.

Further, referring to in FIG. 3, the aforementioned actuating rod 3 may specifically comprise a middle rod 30, a forced portion 31, and a lifting portion 32. The forced portion 31 and the lifting portion 32 are located at two ends of the middle rod 30, respectively. The forced portion 31 may, for example, further comprise a pressing surface 31*a*, a maintaining surface 31*b* and a free end surface 31*c*.

Optionally, the actuating rod 3 may further comprise a rotation bulge 33 and a second avoiding portion 301, as illustrated in FIG. 3. The rotation bulge 33 may be compatible with the rotation groove 113 of the end cap 11. The second avoiding portion 301 may be configured to avoid contacting a part of the cover door 6.

Further, the actuating rod 3 may be specifically mounted onto the end cap 11. When the process cartridge C is mounted to the apparatus, and a cover door 6 (shown in FIG. 5A) of the apparatus is closed, the actuating rod 3 gets in contact with the cover door 6 and receives a force applied by the cover door 6. Accordingly, the actuating rod 3 may swing in the plane defined by the longitudinal direction X and the lateral direction Y.

In one embodiment, the actuating rod 3 is a lever. That is, when in operation, the actuating rod 3 may swing around a rotation portion. The rotation portion may be formed by configuring a concave portion in the end cap 11 and configuring a convex portion to be engaged with the convex portion at a corresponding position of the actuating rod 3. Optionally, the rotation portion may be formed by configuring a convex portion in the end cap 11, and configuring a concave portion to be engaged with the convex portion at a corresponding position of the actuating rod 3.

In one embodiment, the actuating rod 3 may be illustrated using an example where a concave portion is configured in the end cap 11, and a convex portion compatible with the concave portion is configured at a corresponding position of the actuating rod 3. That is, the actuating rod 3 may comprise a rotation bulge 33 protruding from the middle rod 30 as the convex portion, and the end cap 11 may comprise a rotation groove 113 compatible with the rotation bulge 33 as the concave portion.

Further, to ensure the working stability of the actuating rod 3, instead of one rotation bulge 33 and one rotation groove 113, two rotation bulges 33 and two rotation grooves 113 may be configured. As shown in FIG. 3, the two rotation bulges 33 may protrude oppositely from the middle rod 30 along a direction perpendicular to the length direction of the middle rod 30. More specifically, the two rotation bulges 33 may protrude along the vertical direction Z (as shown in FIG. 1).

Further, the two rotation bulges 33 may be configured to be separated. When the rotation bulges 33 cooperate with the rotation groove 113, the configuration showing two separately configured rotation bulges 33 may help reduce the frictional force between the rotation bulge 33 and the rotation groove 113. Accordingly, the flexibility of the actuating rod 3 is improved.

To further enhance the working stability of the actuating rod 3, as shown in FIG. 3, a guiding groove 110 may be configured in the end cap 11. When the actuating rod 3 swings, the guiding groove 110 is configured to guide the actuating rod 3, thereby ensuring that the motion trail of the actuating rod 3 is in the plane defined by the longitudinal direction X and the lateral direction Y. Simultaneously, to prevent the actuating rod 3 from falling off from the end cap 11, the aforementioned protecting cover 13 included in the process cartridge housing 1 may be specifically mounted onto the end cap 11. After the actuating rod 3 is mounted, the protecting cover 13 is mounted onto the end cap 11, such that the actuating rod 3 is clamped between the end cap 11 and the protecting cover 13. Similarly, the protecting cover 13 may also play a role in maintaining the motion trail of the actuating rod 3.

Figure 3A:
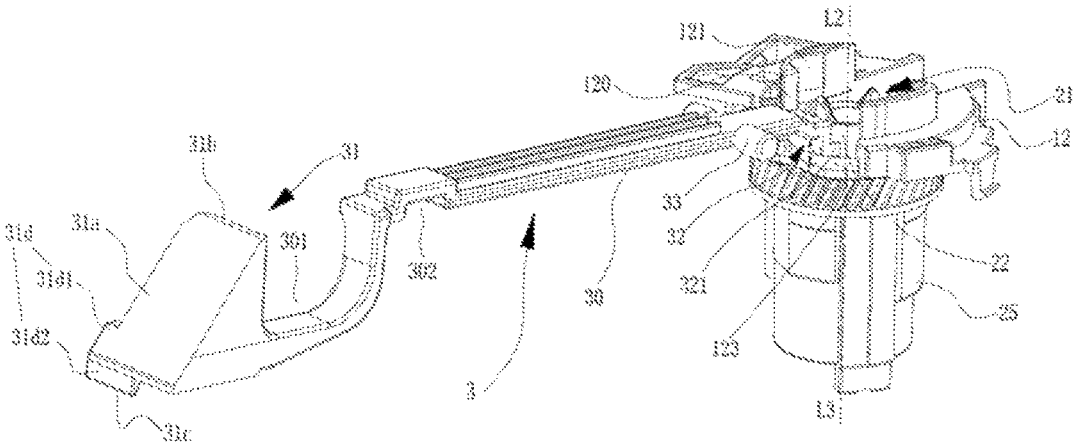
FIG. 3A illustrates a schematic view showing coupling of an actuating rod and a drive transmission device according to embodiments of the present disclosure.
Figure 3B:
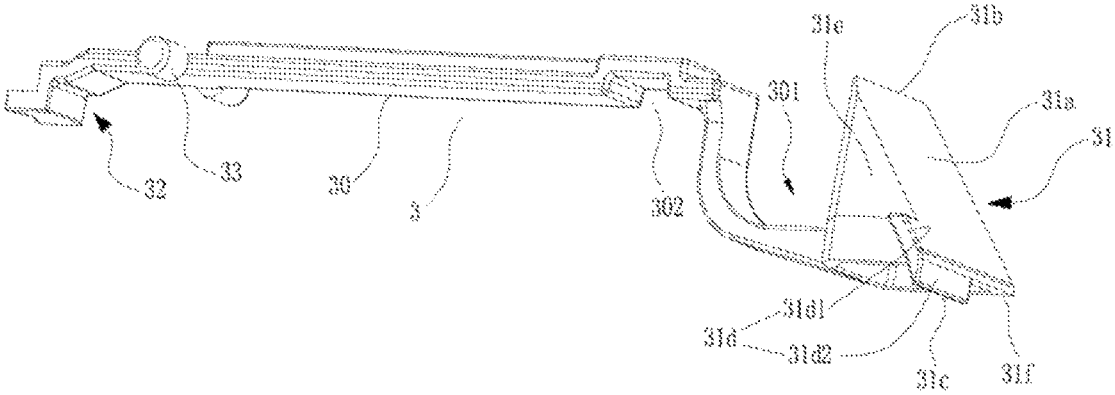
FIG. 3C illustrates a schematic view of an overall structure of a middle member according to embodiments of the present disclosure.
FIG. 3D illustrates a schematic view of an overall structure of a gear portion according to embodiments of the present disclosure.
FIG. 3E illustrates a schematic view of an overall structure of a support according to embodiments of the present disclosure.
FIG. 3F illustrates a schematic view of an overall structure of another support according to embodiments of the present disclosure.
FIG. 3G illustrates a cross-sectional view of an actuating rod and a drive transmission device along a Y direction according to embodiments of the present disclosure.
FIG. 3H illustrates a cross-sectional view of an actuating rod and a drive transmission device along an X direction according to embodiments of the present disclosure.

FIG. 3A illustrates a schematic view showing coupling of an actuating rod and a drive transmission device according to embodiments of the present disclosure. FIG. 3B illustrates a schematic view of an overall structure of an actuating rod according to embodiments of the present disclosure. As shown in FIG. 3A, the actuating rod 3 may comprise a middle rod 30, a forced portion 31, a lifting portion 32, a second avoiding portion 301 and a holding tank 302. Further, referring to FIG. 3B, the forced portion 31 may further comprise a guiding portion 31*d*, a first side surface 31*e*, and a second side surface 31*f*. Optionally, the guiding portion 31*d* may further comprise a first guiding portion 31*d*1 and a second guiding portion 31*d*2.

More specifically, the pressing surface 31*a* may be configured to receive a force from the cover door 6 during a process of closing the cover door 6. Further, the pressing surface 31*a* may be an inclined plane, and the inclined direction of the pressing surface 31*a* is in the plane defined by the longitudinal direction X and the lateral direction Y with respect to a rotation axis L1 of the rotation member. Further, along a negative X direction, a distance between the pressing surface 31*a* and the rotation axis L1 of the rotation member increases (as shown in FIG. 3).

Further, the maintaining surface 31*b* is disposed adjacent to the pressing surface 31*a*. Further, the maintaining surface 31*b* is configured to remain in contact with the cover door 6 after the cover door 6 is closed and receive a force from the cover door 6 constantly.

Further, the guiding portion 31*d* extends from the forced portion 31, and further comprises a first guiding portion 31*d*1 and a second guiding portion 31*d*2. The guiding portion 31*d* may be configured to ensure smooth contact between the cover door 6 and the actuating rod 3. The first side surface 31*e* abuts the pressing surface 31*a*, and the second side surface 31*f* abuts both the first side surface 31*e* and the pressing surface 31*a*.

More specifically, the first guiding portion 31*d*1 extends from the first side surface 31*e*, and the second guiding portion 31*d*2 extends from the second side surface 31*f*. The first guiding portion 31*d*1 and the second guiding portion 31*d*2 may be integrated. By then, the free end surface 31*c* of the forced portion 31 is a free end surface of the second guiding portion 31*d*2.

Optionally, the first guiding portion 31*d*1 and the second guiding portion 31*d*2 may be both flat planes. Further, the first guiding portion 31*d*1 and the second guiding portion 31*d*2 flush with the pressing surface 31*a*. To enhance the stability of the guiding portion 31*d*, the second guiding portion 31*d*2 is configured to incline with respect to the pressing surface 31*a*. For example, the second guiding portion 31*d*2 may be perpendicular to the second side surface 31*f*.

Further, as shown in FIG. 3A, the lifting portion 32 of the actuating rod 3 further comprises an insertion block 321 configured at a free end of the actuating rod 3, and the insertion block 321 may be coupled to the drive transmission device 2.

Further, the second avoiding portion 301 may be configured to avoid contacting a part of the cover door 6 because after the cover door 6 is closed, the maintaining surface 31*b* may remain in contact with the cover door. The second avoiding portion 301 may be configured at the middle rod 30, or may be configured adjacent to the forced portion 31. More specifically, the second avoiding portion 301 may recess from the middle rod 30 in a direction approaching the process cartridge housing 1. That is, the second avoiding portion 301 may bend from the middle rod 30 in a direction facing away the maintaining surface 31*b*. The second avoiding portion 301 may be, for example, groove-shaped.

Figure 3C:
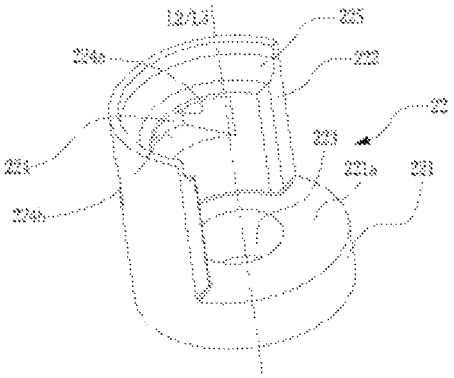

Hereinafter, the support 12 is described in detail with reference to FIG. 3A, FIG. 3E, and FIG. 3F. For ease of description, FIG. 3A only illustrates the coupling state of the support 12, the drive transmission device 2, and the actuating rod 3. FIG. 3E illustrates a schematic view of an overall structure of a support according to embodiments of the present disclosure. FIG. 3F illustrates a schematic view of an overall structure of another support according to embodiments of the present disclosure.

Referring to FIG. 3E, as described previously, the support 12 may comprise a notch 120 having a notch bottom surface 123, a first lug 121, a second lug 122, and a third through-hole 124. The notch 120 is located upstream of the first lug 121 and the second lug 122 along the mounting direction A of the process cartridge. More specifically, the notch 120 is located between the first lug 121 and the second lug 122. The first lug 121 and the second lug 122 are configured in the periphery of the third through-hole 124 along a circumferential direction. The third through-hole 124 is configured to allow the drive transmission device 2 to pass through.

After the support 12, the drive transmission device 2, and the actuating rod 3 are coupled to each other, the notch 120 may be still located upstream of the drive transmission device 2 along the mounting direction A of the process cartridge. Optionally, the first lug 121 and the second lug 122 may also be an integral lug formed along the circumferential direction of the third through-hole 124. By then, the notch 120 is located upstream of the integrally formed lug.

In one embodiment, the notch 120 may be a U-shaped portion having a notch bottom surface 123, and the notch bottom surface 123 may be a flat plane. Optionally, the notch bottom surface 123 may also be a curved surface or an irregular surface. That is, the notch bottom surface 123 may be defined as a surface nearest to the rotation unit along the rotation axis L1.

As shown in FIG. 3A, after passing through the notch 120, the actuating rod 3 may be coupled to the drive transmission device 2. The drive transmission device 2 may pass through the third through-hole 124 and be mounted onto a longitudinal end of the rotation member, and may further be mounted onto the process cartridge C. Optionally, the support 12 may also be fixedly mounted onto the process cartridge C.

After coupling between the actuating rod 3 and the drive transmission device 2 is completed, a third space S3 (labeled in FIG. 3A) is formed between the actuating rod 3 and the projection of the actuating rod 3 onto the notch bottom surface 123. That is, the bottom surface of the actuating rod 3 is not in contact with the projection of the actuating rod 3 onto the notch bottom surface 123. Further, as shown in FIG. 3A, a height difference between the actuating rod 3 and the projection of the actuating rod 3 onto the notch bottom surface 123 may be denoted by h3. When the drive transmission device 2 moves in a direction towards the rotation unit, the third space S3 is configured to provide a space allowing the lifting portion 32 to move towards the rotation unit. Accordingly, the issue that the drive transmission device 2 can hardly disengage with the drive output member 4 due to the movement of the lifting portion 32 being blocked may be avoided.

Given that the notch 120 functions to allow the actuating rod 3 to pass through and be coupled to the drive transmission device 2, and the notch 120 further provides a partial motion space when the actuating rod 3 performs extending or retracting movement together with the drive transmission device 2, the notch 120 may be a U-shaped portion having the notch bottom surface 123. Optionally, the notch 120 may also be a through-hole, that is, the notch 120 may further include a notch top surface (not shown). By then, the notch 120 is mouth-shaped, and the actuating rod 3 may pass through the space between the notch top surface and the notch bottom surface.

Simultaneously, to ensure that the lifting portion 32 has a motion space facing away the rotation unit, after the coupling between the actuating rod 3 and the drive transmission device 2 is completed, other than the third space S3 formed between the actuating rod 3 and the projection of the actuating rod 3 onto the notch bottom surface 123, another space may also be formed between the actuating rod 3 and the projection of the actuating rod 3 onto the notch top surface. Similarly, the notch top surface may be defined as a surface of the notch 120 farthest from the rotation unit along the rotation axis L1.

Further, as shown in FIG. 3F, the notch 120 may optionally be a space with no notch top surface and no notch bottom surface. That is, the notch 120 may be integrated with the third through-hole 124. Accordingly, when the support 12, the drive transmission device 2, and the actuating rod 3 are coupled, the actuating rod 3 may be projected onto the gear portion 25 directly. Optionally, the disclosed notch 120 may also be a shape with a notch top surface, without having a notch bottom surface.

The shape of the notch 120 may have several alterations as described above. Take into consideration the product material cost, product structure stability and difficulty of product assembly, the notch 120 may be configured to have a U-shaped portion with only the notch bottom surface 123. Because no top surface exists in the notch 120, no block may be observed when the notch 120 is viewed in a direction from the drive transmission device 2 to the rotation unit along the rotation axis L1. Accordingly, the actuating rod 3 may pass through the notch 120 more quickly. Further, the support with the U-shaped notch may consume less material and has a more stable structure in production, rendering a lower cost.

In one embodiment, as shown in FIG. 3, the drive transmission device 2 may comprise a drive receiving member 21, a resetting member 24, a gear portion 25, a connecting pin 26, and a connecting member 27. The drive receiving member 21 may be connected to the connecting member 27. The resetting member 24 is connected to the gear portion 25 and the connecting member 27. The connecting member 27 further cooperates with the gear portion 25 to transmit the driving force received by the drive receiving member 21 from the outside to the gear portion 25. Further, the gear portion 25 may be fixedly connected to one longitudinal end of the rotation unit, and configured to drive the rotation unit to rotate after receiving the driving force.

Further, the lifting portion 32 of the actuating rod 3 is coupled to the connecting member 27, and configured to control the movement of the connecting member 27, thereby controlling the extension and retraction of the drive receiving member 21. Accordingly, the drive receiving member 21 may extend and retract along the direction of a rotation axis L2 of the drive receiving member 21.

According to the present disclosure, after the mounting of the drive transmission device 2 is completed, the resetting member 24 may remain in a state where a force is applied on the resetting member 24. Further, no matter what kind of state the drive transmission device 2 is in, the rotation axis L2 of the drive receiving member 21 and a rotation axis L3 of the gear portion 25 may remain to be coaxial with the rotation axis L1 of the rotation member. Thus, the drive receiving member 21 may also extend and retract along the rotation axis L1 of the rotation member.

More specifically, the drive receiving member 21 may comprise a first portion 211, and a second portion 212 connected to the first portion 211. The first portion 211 may be a cylinder configured to connect with the connecting member 27, thus further connecting with an end of the rotation member. To implement the connection between the drive receiving member 21 and the connecting member 27, a first connecting hole 211*a* is often configured in the first portion 211 of the drive receiving member 21. Correspondingly, a second connecting hole (not shown) may be configured in the connecting member 27, and the connecting pin 26 may pass through the second connecting hole and the first connecting hole 211*a*, respectively.

Optionally, the connection between the drive receiving member 21 and the connecting portion 27 may be implemented by configuring a protrusion on the first portion 211 of the drive receiving member 21 and configuring a slot on the connecting member 27.

The second portion 212 of the drive receiving member 21 may be configured to be coupled to the drive output member 4 and receive the driving force from the drive output member 4. More specifically, the second portion 212 may comprise a supporting portion 212*a* connected to the first portion 211, and a drive receiving portion 212*b* protruding from the supporting portion 212*a* in a direction facing away the first portion 211.

When the drive receiving member 21 is coupled to the drive output member 4, the drive receiving portion 212*b* is coupled to the drive output lever 43. Optionally, two drive receiving portions 212*b* are disposed oppositely, and more specifically, the two drive receiving portions 212*b* may be disposed relative to each other along a radical direction of the circumferential direction of the supporting portion 212*a*. Further, the support portion 212*a* may be discoid-shaped, and along the circumferential direction of the supporting portion 212*a*, an inlet port 212*c* may be formed between the two drive receiving portions 212*b*.

Further, as shown in FIG. 3, the resetting member 24 may comprise a pair of tension springs. One end of each tension spring is fixed at the connecting member 27, and the other end is fixed at the gear portion 25. The tension springs remain in a stretched state.

Figure 3D:
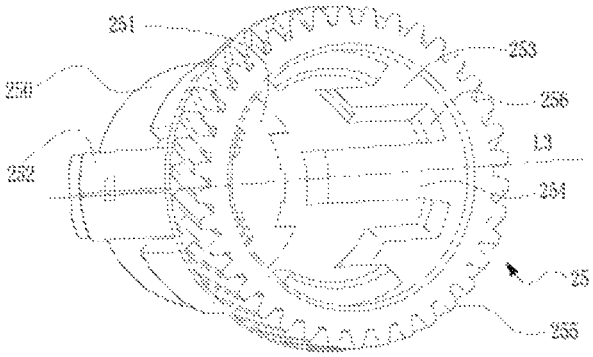
Figure 3E:
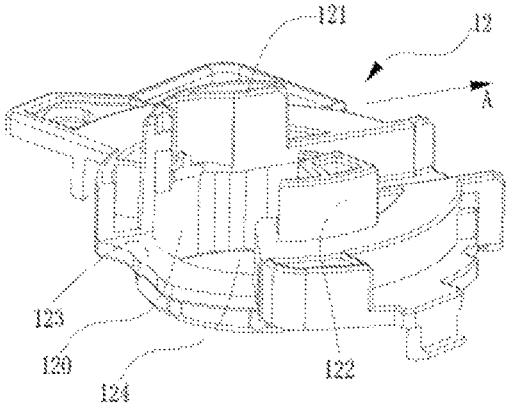
Figure 3F:
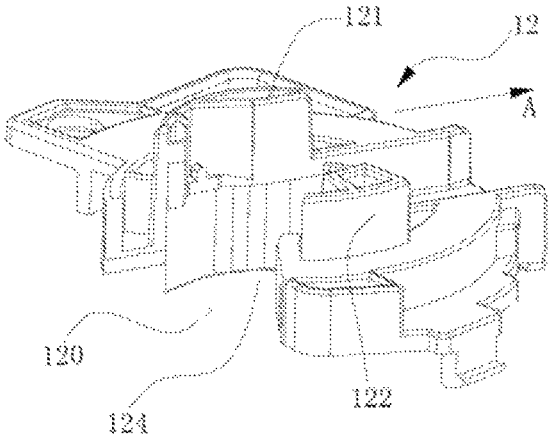

FIG. 3D illustrates a schematic view of an overall structure of a gear portion according to embodiments of the present disclosure. As shown in FIG. 3D, the gear portion 25 may comprise a cylindrical flange body 250, a flange chamber 251 enclosed by the flange body 250, and a first accommodation portion 253 and a second accommodation portion 254 formed in the inner wall of the flange chamber 251. The gear portion 25 may further comprise a gear 255 arranged at one end of the flange body 250 along the rotation axis L3, and an extension portion 252 extending from the flange body 250 in a direction along the rotation axis L3 facing away the gear 255.

Figure 3G:
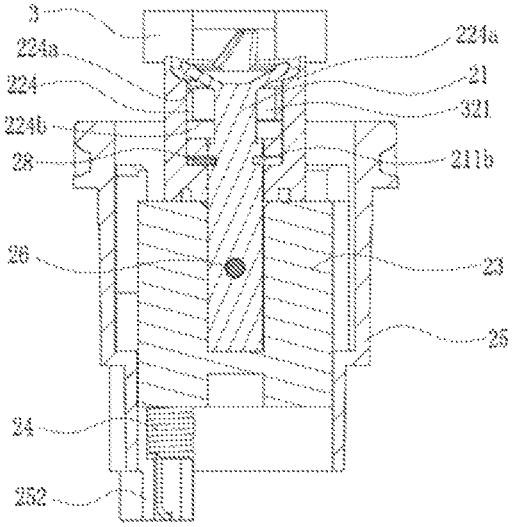
Figure 3H:
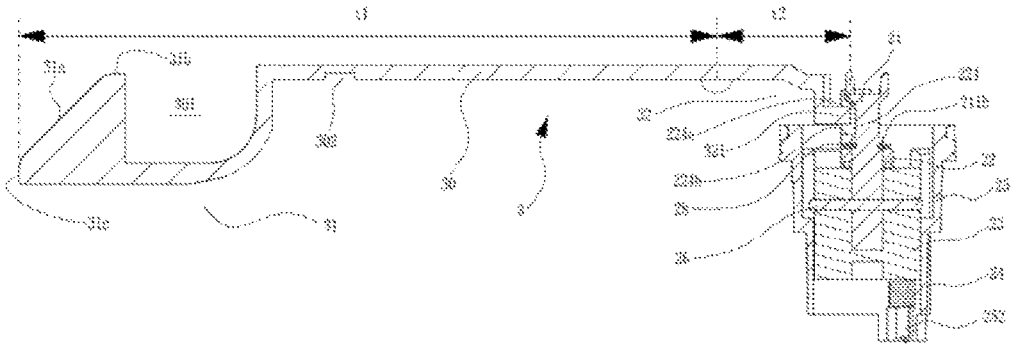

The gear 255 may be configured to transmit the driving force transmitted from the drive transmission portion 233 to other portions of the process cartridge C. The extension portion 252 may be configured to fix the other end of the tension springs 24 (as shown in FIG. 3G and FIG. 3H). After the assembly of the drive transmission device 2 is completed, the tension springs 24 are included in the second accommodation portion 254, and the drive transmission portion 233 is included in the first accommodation portion 253.

Further, referring to FIG. 3, the connecting member 27 may comprise a middle member 22 and a supporting member 23 disposed separately. The drive receiving member 21 may pass through the middle member 22 and enter the supporting member 23. Accordingly, the drive receiving member 21 and the supporting member 23 are connected. That is, the drive receiving member 21, the middle member 22, and the supporting member 23 may be integrated.

As shown in FIG. 3, the supporting member 23 may further comprise a supporting desk 230, a supporting hole 232 facing towards the middle member 22, and a drive transmission portion 233 protruding outwards from the supporting desk 230. The first portion 211 of the drive receiving member 21 may enter the supporting hole 232, and the drive transmission portion 233 may cooperate with the gear portion 25 to transmit a torque from the supporting member 23 to the gear portion 25. The supporting hole 232 may be a through-hole or a blind hole, as long as the supporting hole 232 holds the first portion 211 of the drive receiving member 21.

When the connecting member 27 and the drive receiving member 21 are connected via the connecting pin 26, the supporting member 23 may further comprise a third connecting hole 231 passing through the supporting desk 230. As described above, one end of each tension spring 24 is fixed at the connecting member 27. Accordingly, one end of each tension spring 24 may be fixed at the middle member 22 or the supporting member 23.

In one embodiment, one end of each tension spring 24 is fixed at the supporting member 23. The supporting member 23 may further comprise a protrusion portion 234 protruding outwards from the supporting desk 230. Thus, one end of each tension springs is fixed at the protrusion portion 234.

FIG. 3C illustrates a schematic view of an overall structure of a middle member according to embodiments of the present disclosure. As illustrated in FIG. 3C, the middle member 22 may comprise a base 221, a joint portion 222 extending outwards from a base upper surface 221*a* along the rotation axis L2/L3, a first though-hole 223 passing through the base 221, a second through-hole 224 passing through the joint portion 222, and a first avoiding portion 225 disposed on a top end of the joint portion 222.

The first avoiding portion 225 may be located above the second through-hole 224 along the rotation axis L2/L3, and when the drive receiving member 21 retracts, the supporting portion 212*a* may face the first avoiding portion 225. The center line of the first through-hole 223 intersects with the center line of the second through-hole 224. In particular, the first through-hole 223 is configured to allow the first portion 211 of the drive receiving member 21 to pass through, and the second through hole 224 is configured to be coupled to the actuating rod 3. Accordingly, the center line of the first through-hole 223 is the rotation axis L2 of the drive receiving member 21.

In one embodiment, the base 221 is a cylindrical object, and the joint portion 222 extends outwards from a part of, instead of entire periphery of the base upper surface 221*a*. As described above, the lifting portion 32 of the actuating rod 3 is coupled to the connecting member 27, and more specifically, the insertion block 321 of the lifting portion 32 is inserted into the second through-hole 224 (as shown in FIG. 3G and FIG. 3H).

More specifically, the lifting portion 32 of the actuating rod 3 is coupled to the connecting member 27, and configured to control the movement of the connecting member 27, thereby controlling the extension and retraction of the drive receiving member 21. The connecting member 27 comprises the middle member 22 and the supporting member 23 disposed separately. The drive receiving member 21 passes through the middle member 22 and enters the supporting member 23. After the middle member 22 receives a force applied by the lifting portion 32, a transmission mechanism is needed to transmit the force to the drive receiving member 21.

In one embodiment, the transmission mechanism is connected to the first portion 211 of the drive receiving member 21, and contacts the base upper surface 221*a* of the middle member 22. More specifically, the transmission mechanism is a clamp spring 28 fixed at the first portion 211 of the drive receiving member 21, or a step portion formed by extending outwards from the surface of the first portion 211 of the drive receiving member 21.

FIG. 3G illustrates a cross-sectional view of an actuating rod and a drive transmission device along a Y direction according to embodiments of the present disclosure. FIG. 3H illustrates a cross-sectional view of an actuating rod and a drive transmission device along an X direction according to embodiments of the present disclosure. As shown in FIG. 3, FIG. 3G and FIG. 3H, when the transmission mechanism is the clamp spring 28, to prevent the clamp spring 28 from falling off, a clamping groove 211*b* may be configured on an external surface of the first portion 211 of the drive receiving member 21, and the clamp spring 28 may be clamped to the clamping groove 211*b*.

After the assembly of the drive transmission device 2 is completed and the actuating rod 3 is connected to the drive transmission device 2, as shown in FIG. 3G and FIG. 3H, the insertion block 321 of the lifting portion 32 may be inserted into the second through-hole 224 of the middle member 22. Further, the drive receiving member 21 may pass through the middle member 22 and enter the supporting member 23. The connecting pin 26 may pass through the supporting member 23 and the drive receiving member 21. One end of the tension springs 24 may be fixed at the connecting member 23, and the other end may be fixed at the extension portion 252.

As described above, the actuating rod 3 may be a lever rotating around the rotation portion. Thus, as shown in FIG. 3H, to ensure that the lifting portion 32 generates a force large enough, a distance t1 from a free end surface 31*c* of the forced portion 31 to a midpoint of the rotation portion and a distance t2 from an end surface of the insertion block 321 to the midpoint of the rotation portion may satisfy a relationship as follows: t1>5t2. Where, t1 and t2 refer to distances in the length direction of the actuating rod 3. More specifically, as illustrated in FIG. 3, t1 and t2 are lengths alone the lateral direction Y of the process cartridge C.

Figure 4:
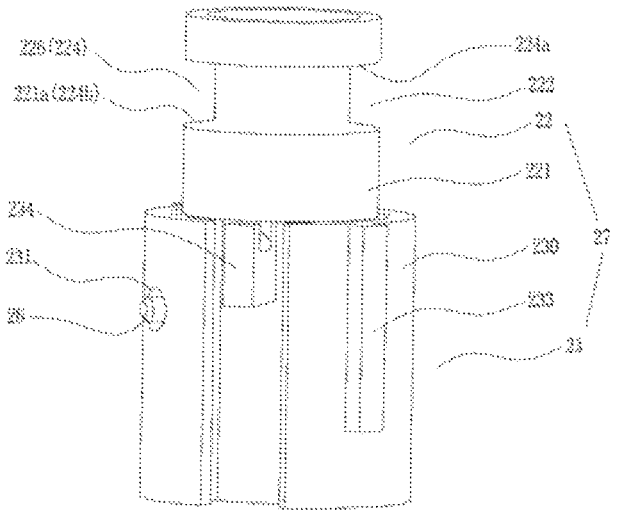
FIG. 4 illustrates a structural schematic view of a connecting member in a drive transmission device according to embodiments of the present disclosure.

FIG. 4 illustrates a structural schematic view of a connecting member 27 according to embodiments of the present disclosure. As illustrated in FIG. 4, different from the above-described embodiments, the supporting member 23 and the middle member 22 are integrated. The drive receiving member 21 may still pass through the middle member 22 and enters the supporting member 23, and the joint portion 222 is formed by extending outwardly from the entire circumferential direction of the base upper surface 221*a*. Further, an annular groove 226 configured to hold the insertion block 321 is disposed along the circumferential direction of the joint portion 222. The annular groove 226 is equivalent to the above-mentioned second through-hole 224, and the base upper surface 221*a* is equivalent to a bottom surface 224*b* of the above-described second-through hole 224.

The middle member 22 and the supporting member 23 are integrated, and the drive receiving member 21 is connected to the supporting member 23 via the connecting pin 26. Accordingly, when the insertion block 321 applies a force on the middle member 22, the force may further be applied on the drive receiving member 21 via the middle member 22 and the supporting member 23, thereby allowing the extension and retraction of the drive receiving member 21.

Hereinafter, the mounting process of the process cartridge C and the extension and retraction process of the drive receiving member 21 are described in detail with reference to the accompanying drawings. For ease of observing the motion process of the drive receiving member 21, the support 12 is not shown in the accompanying drawings as below.

Figure 5A:
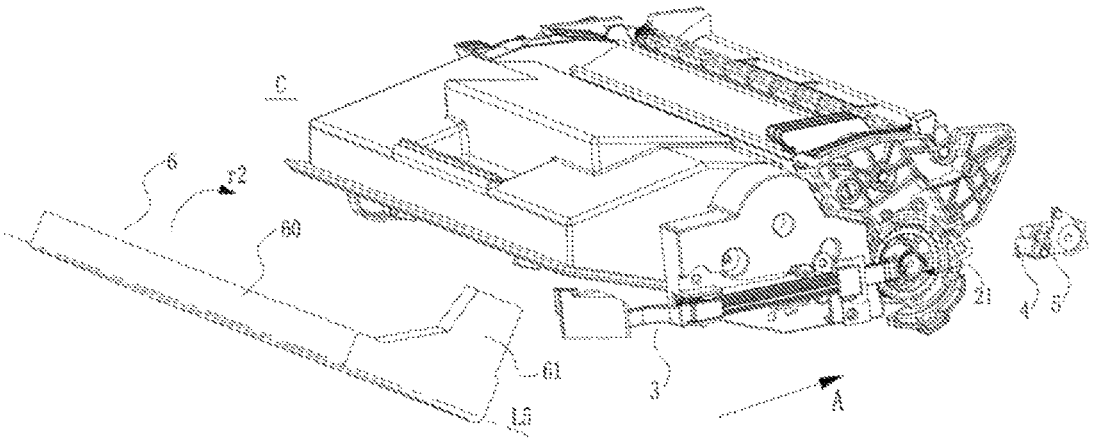
FIG. 5A illustrates a schematic view of a state of a process cartridge before being mounted at a predetermined position of an apparatus according to embodiments of the present disclosure.
Figure 5B:
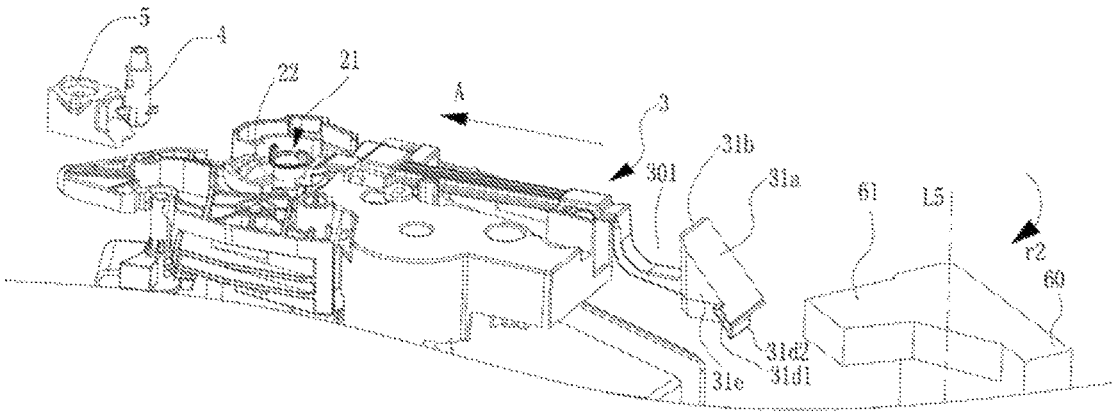
FIG. 5B illustrates a schematic view of FIG. 5A observed along a negative Z direction according to embodiments of the present disclosure.

FIG. 5A illustrates a schematic view of a state of a process cartridge before being mounted in a predetermined position of an apparatus. FIG. 5B illustrates a schematic view of FIG. 5A observed along a negative Z direction. As shown in FIG. 5A and FIG. 5B, the cover door 6 in the apparatus may comprise a body 60, and an actuating portion 61 protruding from the body 60 into the apparatus.

The body 60 may switch between an open position and a close position by rotating around a rotation axis L5 along a direction denoted by r2 or a direction opposite to r2. After being mounted onto the apparatus, the process cartridge C may move towards the drive output member 4 and the guiding member 5 along an A direction. As described above, the tension springs 24 remain in a stretched state. Accordingly, the drive receiving member 21 may simultaneously be in a retracted state.

Figure 6A:
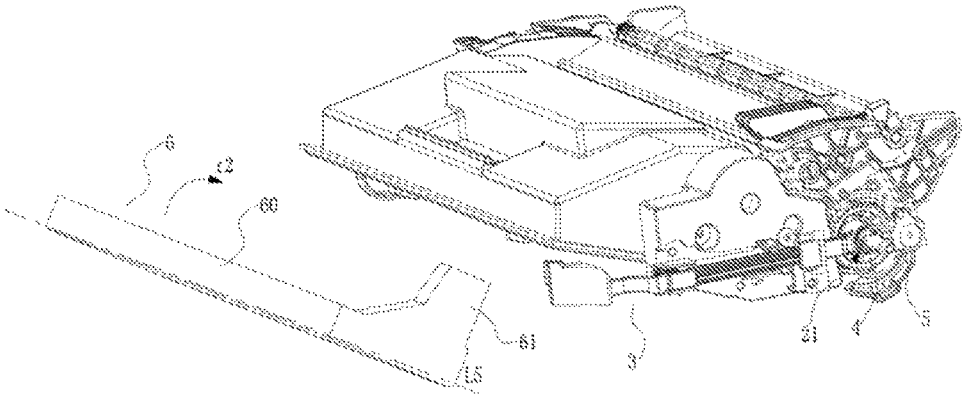
FIG. 6A illustrates a schematic view of a state of a process cartridge reaching a predetermined position when a drive receiving member is in a dead angle mounting position according to embodiments of the present disclosure.
Figure 6B:
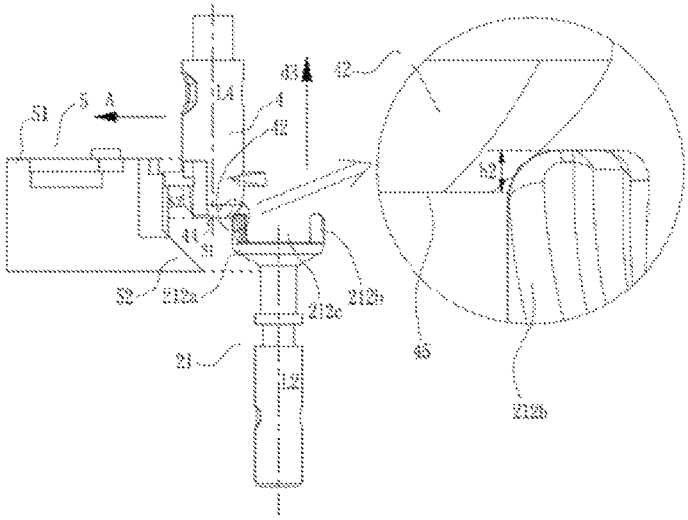
FIG. 6B illustrates a schematic view showing a position relationship between a drive receiving, member, a drive output member, and a guiding member along a direction perpendicular to a mounting direction when a drive receiving member is in a dead angle mounting position according to embodiments of the present disclosure.
Figure 6C:
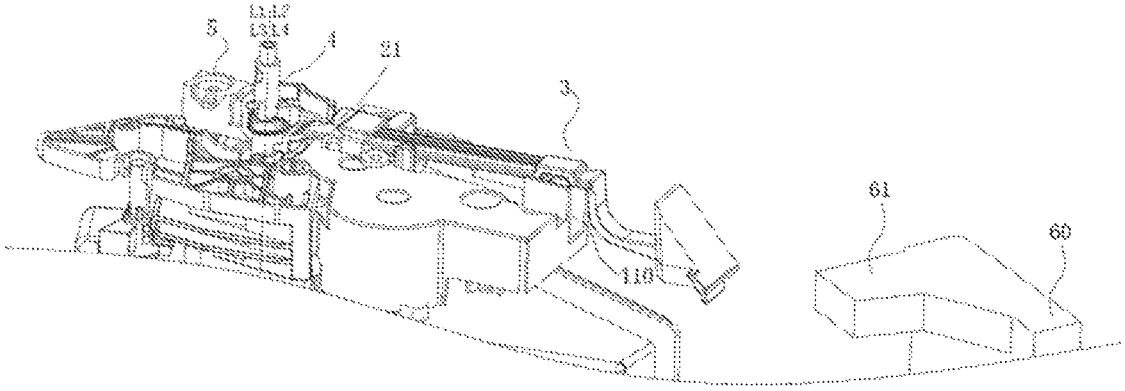
FIG. 6C illustrates a schematic view of FIG. 6A observed along a negative Z direction according to embodiments of the present disclosure.

FIG. 6A illustrates a schematic view of a state of a process cartridge reaching a predetermined position when a drive receiving member is in a dead angle mounting position. FIG. 6B illustrates a schematic view showing a position relationship between a drive receiving member, a drive output member, and a guiding member along a direction perpendicular to a mounting direction when a drive receiving member is in a dead angle mounting position. FIG. 6C illustrates a schematic view of FIG. 6A observed along a negative Z direction. As shown in FIG. 6A to FIG. 6C, the drive receiving member 21 is in a dead angle mounting position. To more clearly describe the dead angle position, FIG. 6B only illustrates the drive receiving member 21, the drive output member 4, and the guiding member 5.

Specifically, a line connecting the two drive receiving portions 212*b* is parallel to the mounting direction A, and a line connecting centers of the projections of the two inlet ports 212*c* on the supporting portion 212*a* is perpendicular to the mounting direction A. Viewed from a direction perpendicular to the mounting direction A and the rotation axis L2/L4, in the direction where the rotation axis L2/L4 lies along, the drive receiving portion 212*b* and the taper portion 42 have an overlapping region with a height of h2.

Accordingly, when the drive receiving portion 212*b* touches the taper portion 42, that is, the taper portion 42 interferes the drive receiving portion 212*b*, the process cartridge C may stop moving along the direction A due to the existence of the overlapping region. That is, the dead angle of mounting is formed.

As described above, the driving shaft 41 has a certain extension and retraction amount in the direction of the rotation axis L4, and the surface of the taper portion 42 is an inclined plane. Accordingly, when a force is continuously applied on the process cartridge C along the direction A, the drive receiving portion 212*b* may squeeze the taper portion 42, such that the drive output member 4 may retract along a direction d3. Finally, the drive receiving portion 212*b* located downstream of the direction A passes through the taper portion 42, and the process cartridge C reaches the predetermined mounting position. Simultaneously, the drive receiving member 21 is in a retracted state.

The tension springs 24 applies a tensile force on the drive receiving member 21 through the supporting member 23, such that the drive receiving member 21 approaches the rotation unfit along a direction d1. As described above, the insertion block 321 of the actuating rod 3 is connected to the middle member 22 through the second through-hole 224 of the middle member 22, and the middle member 22 transmits the force to the drive receiving member 21 through the transmission mechanism.

Accordingly, when the drive receiving member 21 receives a tensile force from the tension spring 24, the tensile force may be transmitted to the insertion block 321 through the transmission mechanism and the middle member 22. More specifically, the top surface 224*a* of the second through-hole 224 contacts the insertion block 321 (as shown in FIG. 3G and FIG. 3H). By then, the actuating rod 3 no longer contacts the guiding groove 110, and the rotation axis L1 of the rotation member, the rotation axis L2 of the drive receiving member 21, the rotation axis L3 of the gear portion 25 and the rotation axis L4 of the drive output member 4 are coaxial.

Figure 6D:
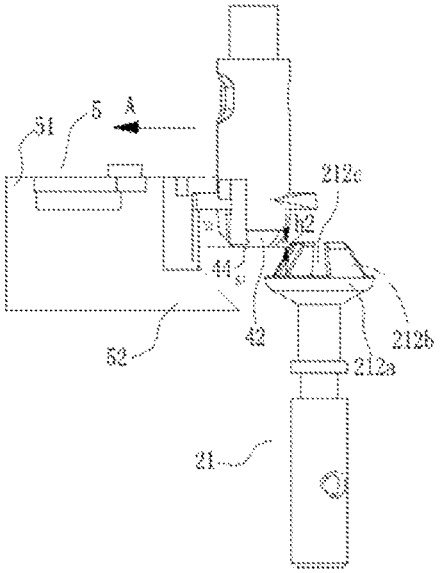
FIG. 6D illustrates a schematic view showing a position relationship between a drive receiving member, a drive output member, and a guiding member along a direction perpendicular to a mounting direction when a drive receiving member is in a non-dead angle mounting position according to embodiments of the present disclosure.
Figure 6E:
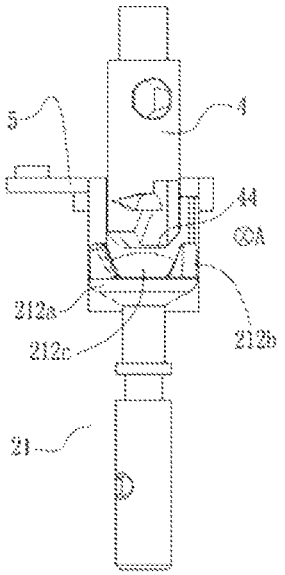
FIG. 6E illustrates a schematic view showing a position relationship between a drive receiving member, a drive output member, and a guiding member along a mounting direction when a drive receiving member is in a non-dead angle mounting position according to embodiments of the present disclosure.

FIG. 6D illustrates a schematic view showing a position relationship between a drive receiving member, a drive output member, and a guiding member along a direction perpendicular to a mounting direction when a drive receiving member is in a non-dead angle mourning position. FIG. 6E illustrates a schematic view showing a position relationship between a drive receiving member, a drive output member, and a guiding member along the mounting direction when a drive receiving member is in a non-dead angle mounting position.

As shown in FIG. 6D and FIG. 6E, the drive receiving member 21 is in a non-dead angle mounting position. Similarly, to more clearly describe the position, FIG. 6D and FIG. 6E only illustrates the drive receiving member 21, the drive output member 4 and the guiding portion 5.

The line connecting the two drive receiving portions 212*b* and the mounting direction A form an inclined angle, and the inclined angle may be greater than 0 degree and smaller than 180 degree. The line connecting the centers of the projections of the two inlet ports 212*c* on the supporting portion 212*a* may no longer be perpendicular to the mounting direction A. An optional position of the non-dead angle of mounting has an inclined angle of 90 degree. That is, the line connecting the two drive receiving portions 212*b* is perpendicular to the mounting direction A.

As shown in FIG. 6D and FIG. 6E, although an overlapping region with a height of h2 still exists between the drive receiving portion 212*b* and the taper portion 42, instead of contacting the drive receiving portion 212*b*, the taper portion 42 may enter the inlet port 212*c* because the line connecting the centers of the projections of the two inlet ports 212*c* on the supporting portion 212*a* is parallel to the mounting direction A. Accordingly, the taper portion 42 may not interfere with the drive receiving portion 212*b*, and the process cartridge C may reach the predetermined mounting position. Similarly, as illustrated in FIG. 6A and FIG. 6C, the rotation axes L1, L2, L3 and L4 are coaxial.

Figure 7A:
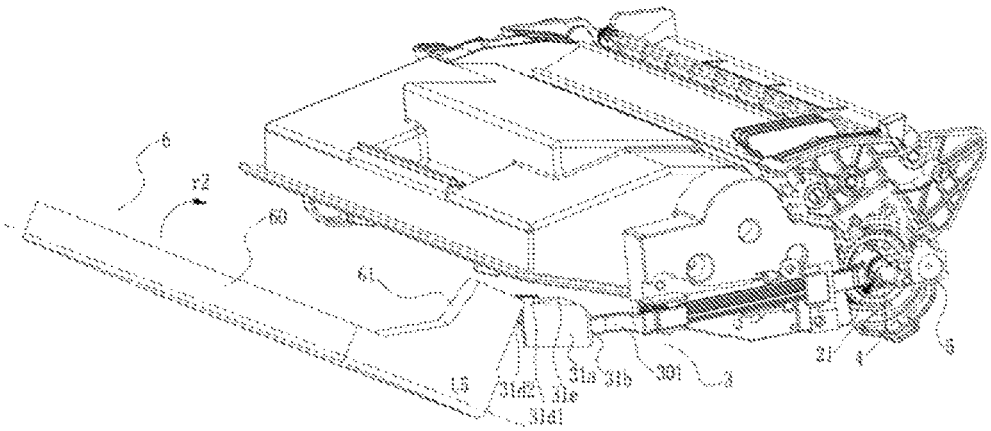
FIG. 7A illustrates a schematic view of a state of a cover door beginning to contact an actuating rod when a process cartridge is mounted at a predetermined position according to embodiments of the present disclosure.
Figure 7B:
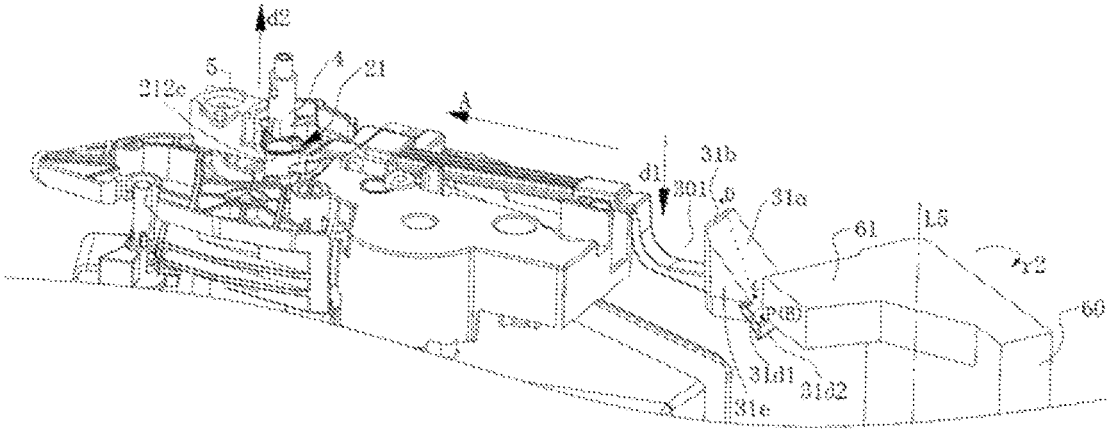
FIG. 7B illustrates a schematic view of FIG. 7A observed along a negative Z direction according to embodiments of the present disclosure.

FIG. 7A illustrates a schematic view of a state where a cover door begins to contact an actuating rod when a process cartridge is mounted at a predetermined position. FIG. 7B illustrates a schematic view of FIG. 7A observed along a negative Z direction. As shown in FIG. 7A, the process cartridge C is mounted at the predetermined position, and the forced portion 31 receives no force, thereby being in a free position. A user may close the cover door 6 along a direction r2 that rotates around the rotation axis L5. As the cover door 6 rotates, the actuating portion 61 may move gradually to the position that contacts the forced portion 31.

As shown in FIG. 7B, an actuating point P on the actuating portion 61 contacts the first guiding portion 31*d*1. Further, because the cover door 6 and the apparatus are loosely fitted, the position where the actuating point P first touches the forced portion 31 may not be fixed, and the actuating point P may contact the pressing surface 31*a* directly. Optionally, the actuating point P may also land outside of the pressing surface 31*a*. For example, the actuating point P may first land in a region corresponding to the first side surface 31*e* or the second side surface 31*f*. When the cover door 6 is further closed along the direction r2, an apparent jerky sense may be noticed, the actuating point P may return back to the pressing surface 31*a*, and the phenomenon that the cover door 6 cannot be closed may occur. Accordingly, the configuration of the guiding portion 31*d* is essential.

The region corresponding to the first side surface 31*e* comprises the first side surface 31*e* itself and a region formed by extending along a direction perpendicular to the first side surface 31*e* facing away the forced portion 31. The region corresponding to the second side surface 31*f* comprises the second side surface 31*f* itself and a region formed by extending along a direction perpendicular to the second side surface 31*f* facing away the forced portion 31.

Figure 8C:
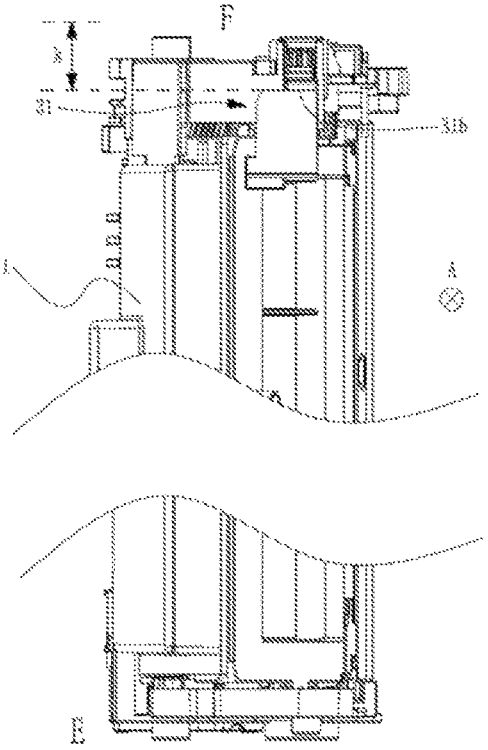
FIG. 8C illustrates a schematic view of a process cartridge observed along a Y direction after a cover door is closed according to embodiments of the present disclosure.
Figure 8D:
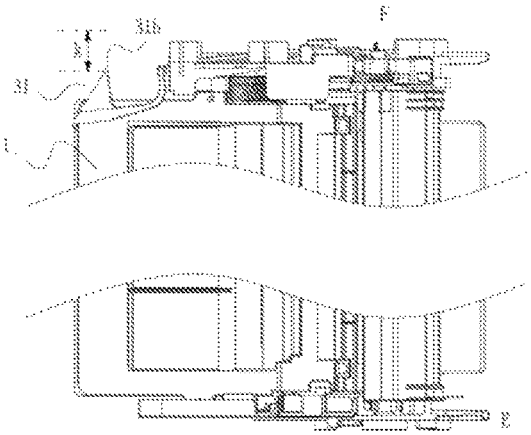
FIG. 8D illustrates a schematic view of a process cartridge observed along a Z direction after a cover door is closed according to embodiments of the present disclosure.
Figure 8A:
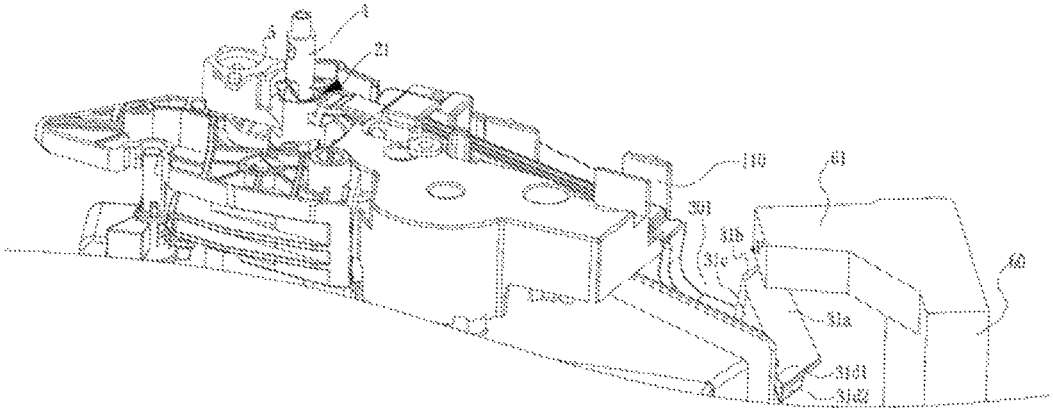
FIG. 8A illustrates a schematic view of a state of a drive receiving member being completely coupled to a drive output member when a cover door is completely closed according to embodiments of the present disclosure.
Figure 8B:
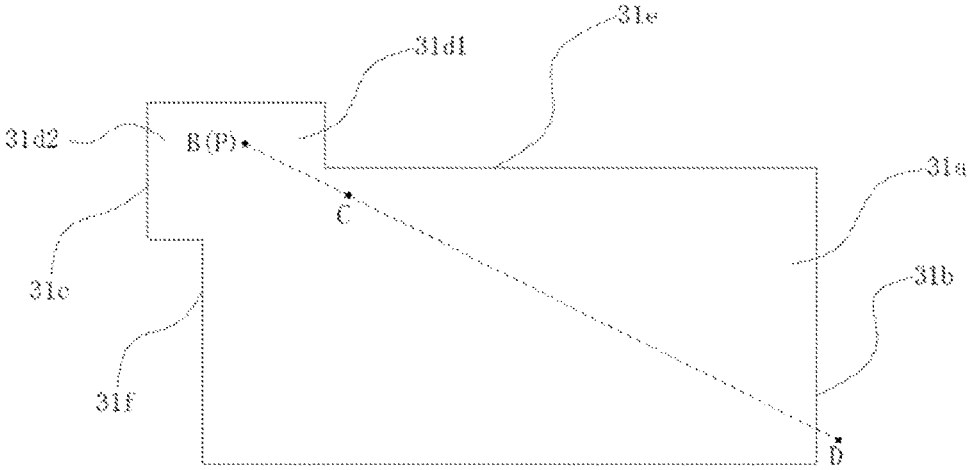
FIG. 8B illustrates a schematic view of a track of a contact point between a cover door and an actuating rod moving in the actuating rod according to embodiments of the present disclosure.

FIG. 8B illustrates a schematic view of a motion trail of a contact point between a cover door and an actuating rod along the actuating rod. As shown in FIG. 7B and FIG. 8B, when the cover door 6 is continued to be closed along the direction r2, the forced portion 31 may move in the direction d1. Simultaneously, the lifting portion 32 may move along the direction d2 illustrated in FIG. 7B. Through the contact between the insertion block 321 and the second through-hole top surface 224*a*, the insertion block 321 moves along the direction d2 carrying the middle member 22. Further, through the transmission mechanism, the drive receiving member 21 may be pulled out along the direction d2, and the tension spring 24 may further stretch. The actuating point P begins to move from point B or point C.

FIG. 8A illustrates a schematic view of a state of a drive receiving member being completely coupled to a drive output member when a cover door is completely closed. As shown in FIG. 8A, when the cover door 6 is completely closed and the actuating portion 61 moves to abut the maintaining surface 31*b*, the actuating rod 3 reaches the bottom end of the guiding groove 110. Simultaneously, the drive receiving member 21 protrudes to the predetermined position, and the actuating point P moves to a position where point D is located. By then, the forced portion 31 reaches an operating position, and the actuating point P enters the second avoiding portion 301.

As the drive output member 4 rotates, the drive receiving portion 212*b* is coupled to the drive output lever 43. The forced portion 31 constantly receives a force from the actuating portion 61 through the maintaining surface 31*b* and remains in a pressed position as shown in FIG. 8A. Correspondingly, the drive receiving member 21 also remains in a position where the drive output portion 4 is coupled to the drive receiving member 21.

Due to the existence of the second avoiding portion 301, after the cover door 6 is closed, a part of the cover door 6 that crosses the maintaining face 31*b* may enter the second avoiding portion 301. Assume no second avoiding portion 301 exists, in a process of closing the cover door 6, the part of the cover door 6 that crosses the maintaining surface 31*b* may abut the top surface of the middle rod 30 (indicated by the dashed line in FIG. 9A), thereby producing a relatively large resistance.

Thus, the major function of the second avoiding portion 301 is to hold the part of the cover door 6 that crosses the maintaining surface 31*b*, thereby reducing the resistance the cover door 6 receives during the door-closing process. Accordingly, the second avoiding portion 301 may further be configured at the forced portion 31. Referring to FIG. 8A, the maintaining surface 31*b* extends along the direction of the actuating rod 3 towards the lifting portion 32. The second avoiding portion 301 recesses from the maintaining surface 31*b* in a direction towards the housing 1 of the process cartridge C. Or the second avoiding portion 301 recesses from the maintaining surface 31 in a direction facing away the maintaining surface 31*b*.

Figure 7C:
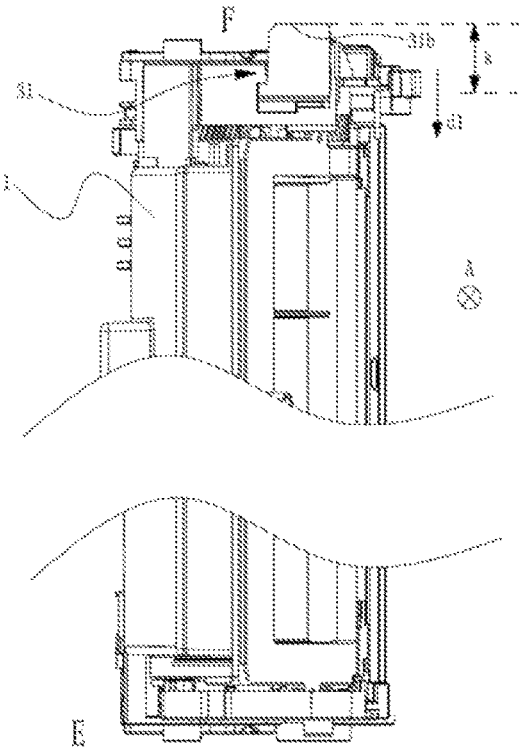
FIG. 7C illustrates a schematic view of a process cartridge in a normal state observed along a Y direction according to embodiments of the present disclosure.
Figure 7D:
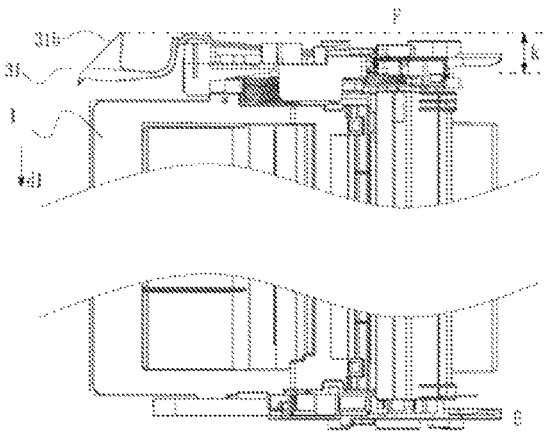
FIG. 7D illustrates a schematic view of a process cartridge in a normal state observed along a Z direction according to embodiments of the present disclosure.

FIG. 7C illustrates a schematic view of a process cartridge in a normal state observed along a Y direction. FIG. 7D illustrates a schematic view of a process cartridge in a normal state observed along a Z direction. FIG. 8C illustrates a schematic view of a process cartridge observed along a Y a Y direction after a cover door is closed. FIG. 8D illustrates a schematic view of a process cartridge observed along a Z direction after a cover door is closed.

Referring to FIG. 7C and FIG. 8C, and referring to FIG. 7D and FIG. 8D, when the forced portion 31 moves from the free position to the operating position forced by the cover door 6, the distance that the forced portion 31 moves may be k along the longitudinal direction X. Using the maintaining surface 31*b* as a reference, after the forced portion 31 moves a distance of k along the direction d1 from the free position to the operating position, the forced portion 31 in the operating position becomes closer to the conducting end E of the process cartridge C.

Figure 9A:
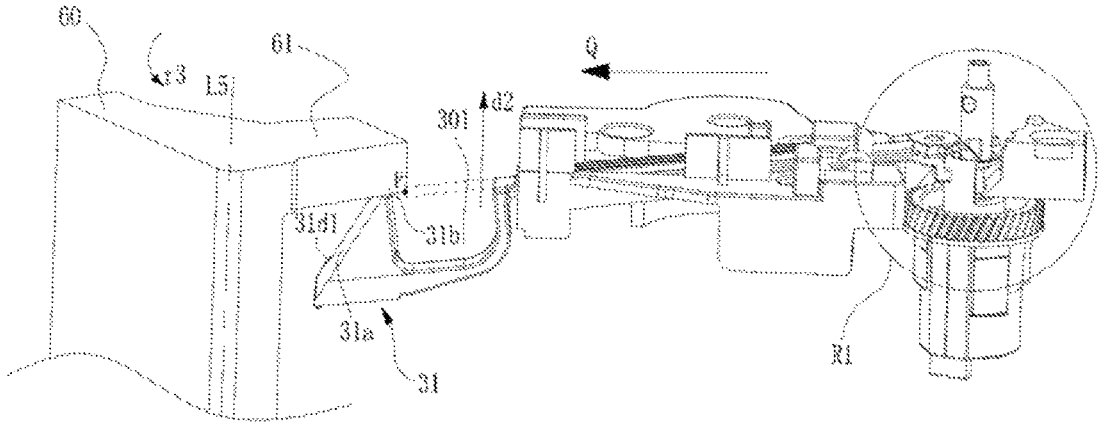
FIG. 9A illustrates a schematic view of a state of a drive receiving member preparing to disengage with a drive output member when the drive output member stops rotating according to embodiments of the present disclosure.
Figure 9B:
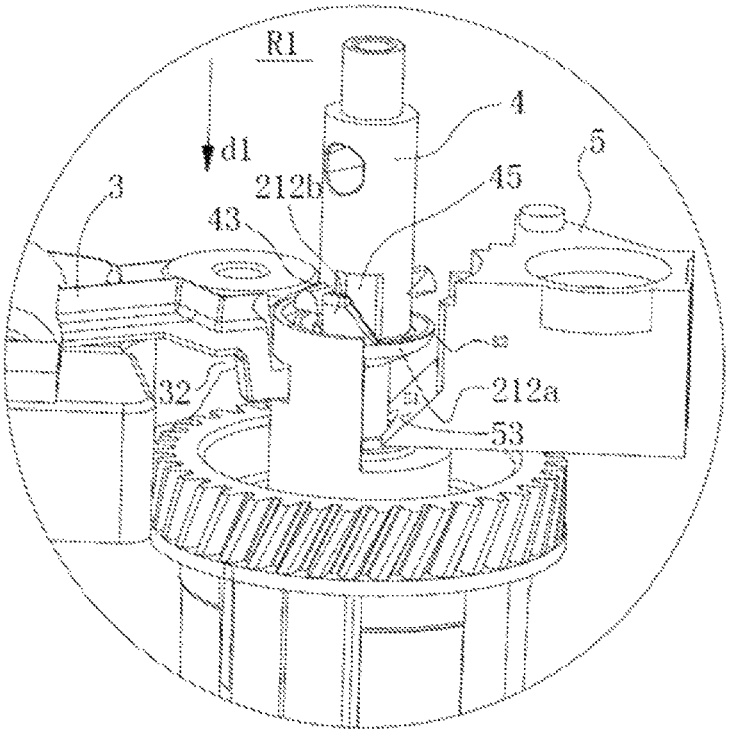
FIG. 9B illustrates an enlarged schematic view of a local area R1 showing relative positions between a drive receiving member and a drive output member when the two are to be disengaged according to embodiments of the present disclosure.

FIG. 9A illustrates a schematic view of a state of a drive receiving member preparing to disengage with a drive output member when the drive output member stops rotating. FIG. 9B illustrates an enlarged schematic view of a local area R1 showing relative positions between a drive receiving member and a drive output member when the drive receiving member and the drive output member are to be disengaged. When the drive output member 4 stops rotating and the user needs to take out the process cartridge C from the apparatus, the drive receiving portions 212*b* of the drive receiving member 21 and the drive output lever 43 of the drive output member 4 remain in a coupled state, and the drive receiving portions 212*b* are face the concave portion 45.

To disengage the drive receiving member 21 from the drive output member 4, the force applied on the forced portion 31 needs to be released first, such that the forced portion 31 may move along the direction d2 shown in FIG. 9A. Simultaneously, the lifting portion 32 moves along the direction d1 shown in FIG. 9B under the effect of the tension spring 24, and the drive receiving member 21 and the middle member 22 are disengaged with the drive output member 4 under the effect of the resilience force of the tension spring 24. Accordingly, the drive receiving portion 212*b* is disengaged with the drive output lever 43.

As shown in FIG. 9A, the cover door 6 moves around the rotation axis L5 indicated by a direction r3, where the direction r3 is opposite to the direction r2. As the cover door 6 moves, the actuating portion 61 moves gradually in a direction facing away the maintaining surface 31*b*, and the actuating point P moves along a motion direction from the point D to the point B shown in FIG. 8B. When the actuating point P no longer contacts the forced portion 31, and the force applied on the forced portion 31 completely disappears, the supporting portion 212*a* moves along the direction d1 under the effect of the tension spring 24 along with the drive receiving member 21 to reach a position abuts the thrust surface 53.

Similar to the mounting process of the process cartridge C as described, when the process cartridge C is taken out from the apparatus along a Q direction, the drive receiving member 21 also has a dead angle disengaging position and a non-dead angle disengaging position, where the Q direction is opposite to the mounting direction A. Accordingly, the dead angle disengaging position and the non-dead angle disengaging position of the drive receiving member 21 are the same as the dead angle mounting position and the non-dead angle mounting position, respectively.

Figure 10A:
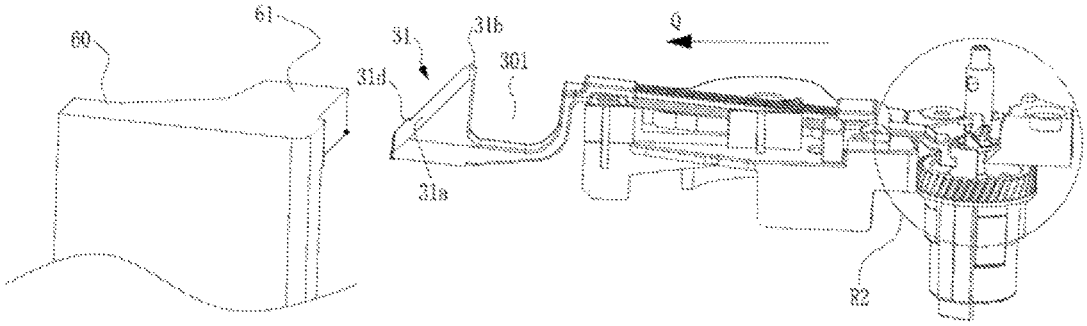
FIG. 10A illustrates a schematic view of a position relationship between a drive receiving member, a drive output member, and a guiding member along a direction perpendicular to a disengaging direction when the drive receiving member is in a non-dead angle disengaging position according to embodiments of the present disclosure.
Figure 10B:
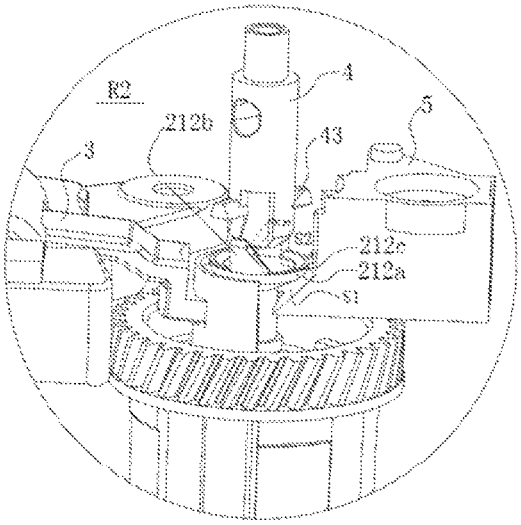
FIG. 10B illustrates an enlarged schematic view of a local area R2 showing relative positions between a drive receiving member, a drive output member, and a guiding member shown in FIG. 10A according to embodiments of the present disclosure.

FIG. 10A illustrates a schematic view of a position relationship between a drive receiving member, a drive output member, and a guiding member along a direction perpendicular to a disengaging direction when the drive receiving member is in a non-dead angle mounting position. FIG. 10B illustrates an enlarged schematic view of a local area R2 showing relative positions between a drive receiving member, a drive output member, and a guiding member shown in FIG. 10A.

The removing process of the process cartridge C when the drive receiving member 21 is in the non-dead angle disengaging position is described with reference in FIG. 10A and FIG. 10B. As shown in FIG. 10A and FIG. 10B, the actuating portion 61 and the forced portion 31 are completely disengaged, the line connecting centers of the projections of the inlet ports 212*c* on the supporting portion 212*a* is not perpendicular to the Q direction, and the drive receiving portion 212*b* is disengaged with the drive output lever 43.

Accordingly, when the process cartridge C is pulled along the Q direction, the drive output lever 43 may not interfere with the movement of the drive receiving portion 212*b* along the Q direction, and the process cartridge C may be taken out smoothly. Thus, the retraction process of the drive receiving member 21 may be realized under the resilience force effect of the tension spring 24. During the movement of the drive receiving member 21 transiting from extension to retraction, the rotation axes L1, L2, L3 and L4 are coaxial.

Figure 11B:
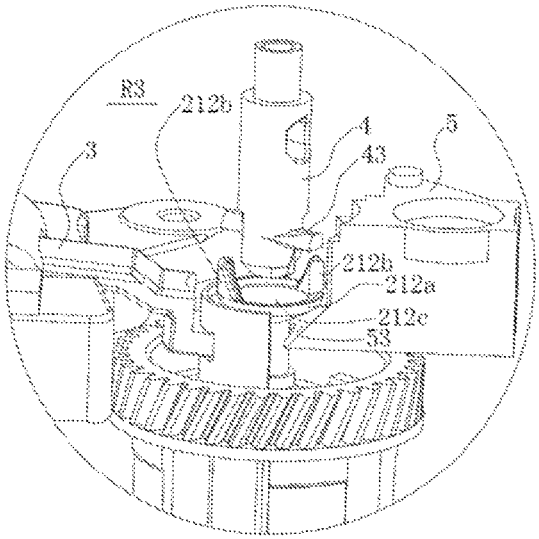
FIG. 11B illustrates an enlarged schematic view of a local area R3 showing relative positions between a drive receiving member, a drive output member, and a guiding member shown in FIG. 11A according to embodiments of the present disclosure.
Figure 11A:
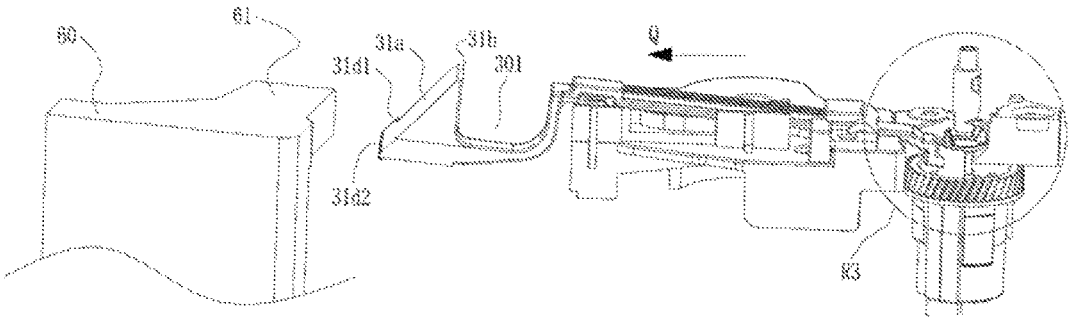
FIG. 11A illustrates a schematic view of a position relationship between a drive receiving member, a drive output member, and a guiding member along a direction perpendicular to a disengaging direction when the drive receiving member is in a dead angle disengaging position according to embodiments of the present disclosure.

FIG. 11A illustrates a schematic view of a position relationship between a drive receiving member, a drive output member, and a guiding member along a direction perpendicular to a disengaging direction when the drive receiving member is in a dead angle disengaging position. FIG. 11B illustrates an enlarged schematic view of a local area R3 showing relative positions between a drive receiving member, a drive output member, and a guiding member shown in FIG. 11A. Hereinafter, the removing process of the process cartridge C when the drive receiving member 21 is in the dead angle disengaging position is described with reference to FIG. 11A and FIG. 11B.

As shown in FIG. 11A and FIG. 11B, the actuating portion 61 and the forced portion 31 are completely disengaged. The line connecting the centers of the projections of the inlet ports 212*c* on the supporting portion 212*a* is perpendicular to the Q direction. Further, the line connecting the two drive receiving portions 212*b* is along a direction the same as the Q direction. Though the drive receiving portion 212*b* and the drive output lever 43 are disengaged, when the process cartridge C is pulled along the Q direction, the movement of the drive receiving portion 212*b* located upstream of the Q direction may be blocked by the driving shaft 41.

Figure 12A:
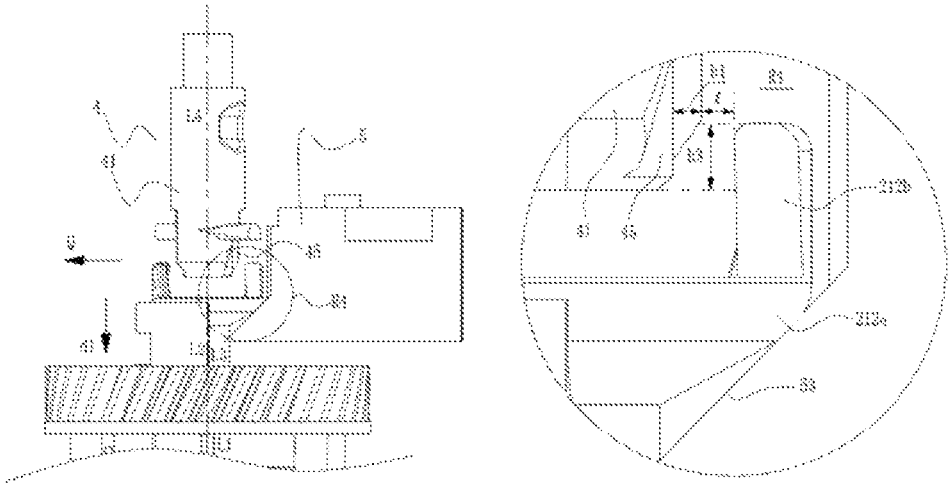
FIGS. 12A-12C illustrate schematic views of a process where a drive receiving member is completely disengaged with a drive output member at a dead angle disengaging position according to embodiments of the present disclosure.
Figure 12B:
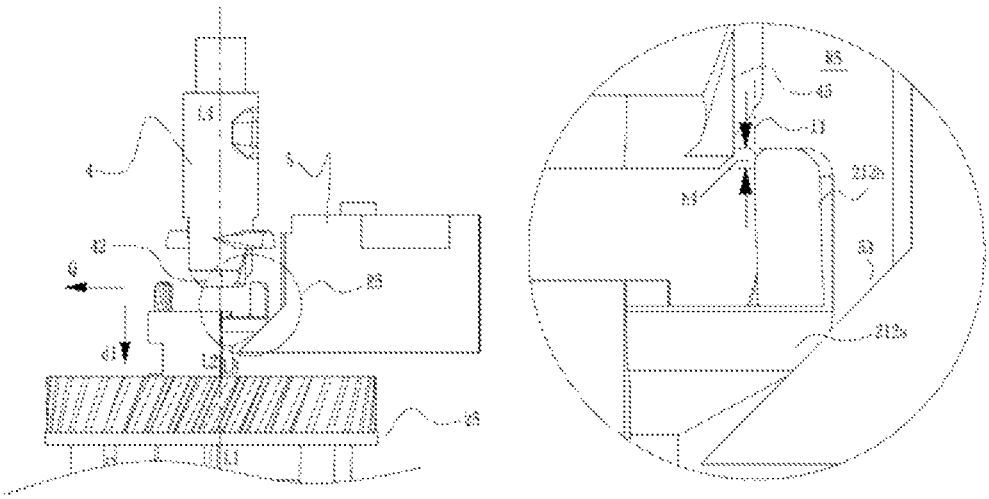
Figure 12C:
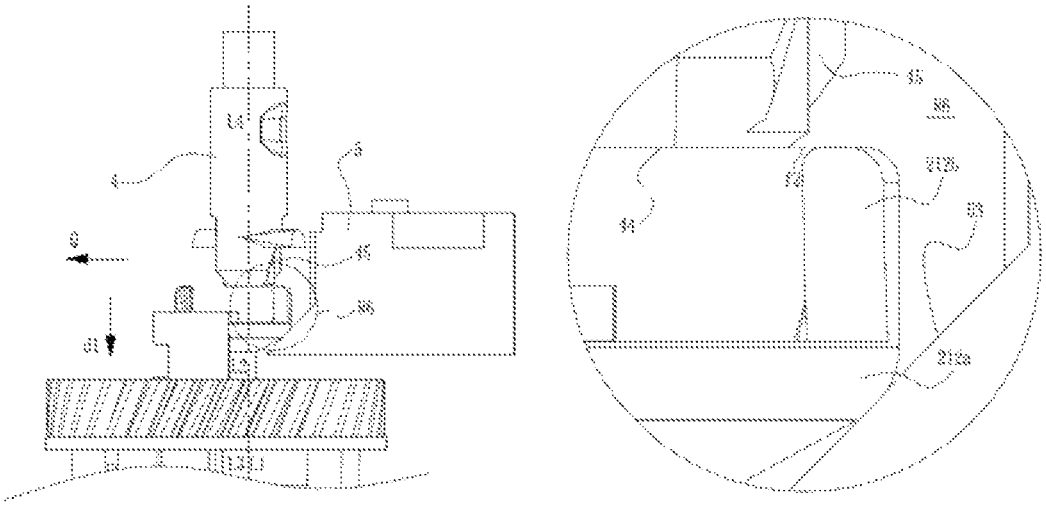

FIGS. 12A-12C illustrate schematic views of a process where a drive receiving member is completely disengaged with a drive output member at a dead angle disengaging position. As shown in FIG. 12A, the supporting portion 212*a* is pulled along the direction d1 by the tension spring 24 to abut the thrust surface 53, and the drive receiving portion 212*b* faces the concave portion 45. Further, along the direction of the rotation axis L4 of the drive output member 4, the drive receiving portion 212*b* and the driving shaft 41 have an overlapping region with a height of h3.

Because a distance l exists between the drive receiving portion 212*b* and an external circumference surface of the driving shaft 41, the drive receiving member 21 may still move a distance of l along the Q direction. Once the drive receiving member 21 moves along the Q direction, the supporting portion 212*a* no longer abuts the thrust surface 53. Accordingly, the drive receiving member 21 may continue to move along the direction d1 under the effect of the tension force of the tension spring 24.

As described above, when the drive output member 4 stops rotating, the drive receiving portions 212*b* faces the concave portion 45. Further, when the drive receiving member 21 moves along the direction d1 under the effect of the tension spring 24, no force is applied in the rotation direction of the drive receiving member 21. Accordingly, the drive receiving member 21 and the concave portion 45 remain in a face-to-face state.

Assuming no concave portion 45 exists, that is, the driving shaft 41 is an integrated cylinder, while moving along the Q direction in FIG. 12A, the drive receiving member 21 may also move along the direction d1. After the drive receiving member 21 moves a distance of l along the Q direction, in the direction of the rotation axis L4 of the drive output member 4, the drive receiving portion 212*b* and the driving shaft 41 may still have an overlapping region. By then, the driving shaft 41 still interferes with the movement of the drive receiving portion 212*b* along the Q direction.

Due to the existence of the concave portion 45, after moving a distance of l along the Q direction, the drive receiving portion 212*b* may continue to move along the Q direction and enter the concave portion 45. FIG. 12B illustrates a schematic view after the drive receiving portion 212*b* enters the concave portion 45. As shown in FIG. 12B, a front edge f1 of the drive receiving portion 212*b* has entered the concave portion 45. By then, in the direction of the rotation axis L4 of the drive output member 4, the height of the overlapping region between the drive receiving portion 212*b* and the driving shaft 41 is reduced to be h4.

As described above, the concave depth of the concave portion 45 is h1. Thus, during the process where the drive receiving member 21 disengages with the drive output member 4, the distance that the drive receiving portion 212*b* moves along the Q direction is h1+l with respect to the drive output member 4. Further, the distance that the drive receiving portion 212*b* moves along the direction of the rotation axis L4 of the drive output member 4 is the height h3 of the overlapping region.

After entering the concave portion 45, the drive receiving portion 212*b* continues to move along the Q direction until no overlapping region exists between the drive receiving portion 212*b* and the driving shaft 41 in the direction of the rotation axis L4 of the drive output member 4. As shown in FIG. 12C, a top end f2 of the drive receiving portion 212*b* at least levels with the end surface 44 of the driving shaft 41 in the Q direction, and the driving shaft 41 no longer interfere with the movement of the drive receiving portion 212*b* along the Q direction. Further, the drive receiving member 21 is completely disengaged with the drive output member 4, and the process cartridge C may be disengaged from the apparatus smoothly.

Through practice, it is found that the tension spring 24 is in a stretched state for a long time. After the process cartridge C is used for a certain period of time, the tensile force of the tension springs 24 maybe weakened, such that the tensile force of the tension springs 24 is not large enough to disengage the drive receiving member 21 with the drive output member 4 when the cover door 6 is opened. Accordingly, the drive receiving member 21 may not return back to an initial retracted state.

To ensure that the process cartridge C operates more stably, the process cartridge C may further comprise an auxiliary resetting member 14 disposed between the actuating rod 3 and the housing 1. Optionally, the auxiliary resetting member 14 is an elastic member and, for example, the auxiliary resetting portion 14 may be a spring.

As shown in FIG. 3, one end of the spring 14 is mounted at the end cap 11. More specifically, a convex column 111 is configured in the guiding groove 110. One end of the spring 14 is mounted onto the convex column 111 and the other end of the spring 14 faces the actuating rod 3. When the drive receiving member 21 is in the retracted state, the actuating rod 3 no longer contacts the spring 14. When the cover door 6 is closed, the actuating rod 3 contacts the spring and compresses the spring 14.

Further, to prevent the spring 14 from deflecting or falling off, the actuating rod 3 may further comprises a holding tank 302. When the cover door 6 is closed, the other end of the spring 14 may be held by the holding tank 302.

As described above, the distance t1 from the free end surface 31*c* of the forced portion 31 to the midpoint of the rotation portion and the distance t2 from the end surface of the insertion block 321 to the midpoint of the rotation portion may satisfy the requirement of t1>5t2. That is, the actuating rod 3 may be treated as a force amplifying mechanism, or a labor-saving lever. When the forced portion 31 receives a small force, the lifting portion 32 may feedback a relatively large force.

When the cover door 6 is opened, if the tensile force of the tension spring 24 is not large enough, the insertion block 321 of the lifting portion 32 may abut the second through-hole bottom surface 224*b* under the effect of the restoring force of the spring 14. Further, the middle member 22 is compressed by a large force fed back by the lifting portion 32 to move along the d1 direction along with the drive receiving member 21 and the supporting member 23. Accordingly, the drive receiving member 21 may be ensured to return back to the initial retracted state smoothly.

Accordingly, when the tensile force of the tension spring 24 is not large enough, the retraction process of the drive receiving member 21 is implemented under the combined effect of the tension spring 24, the spring 14, and the actuating rod 3. As described above, during the mounting and disengaging processes of the process cartridge C, the rotation axis L2 of the drive receiving member 21 remains to be coaxial with the rotation axis L1 of the rotation member. Accordingly, the rotation axis L1 and L2 remain to be perpendicular to the mounting direction A or the disengaging direction Q.

As shown in FIG. 6B, the drive receiving member 21 retracts, and a first position of the drive receiving member 21 is defined when the drive receiving member is in the retracted state. By then, the drive receiving member 21 disengages with the drive output member 4. During the mounting or disengaging process of the process cartridge C, along the direction of the rotation axis L4 of the drive output member 4, the drive receiving portion 212*b* and the driving shaft 41 have an overlapping region with a height of h2.

That is, a region of the drive receiving portion 212*b* with a height of h2 in the direction from the free end of the drive receiving portion 212*b* to the supporting portion 212*a* is located in a region formed by extending the second space S2 in a direction parallel to the mounting direction A or the disengaging direction Q. Further, the rest portion of the drive receiving portion 212*b* is located in a region formed by extending the first space S1 in a direction parallel to the mounting direction A or the disengaging direction Q.

As described above, during a process that the drive receiving member 21 touches the drive output member 4, the drive output member 4 may retract along the direction d3. After the process cartridge C reaches the predetermined mounting position, the drive receiving member 21 may also reach the predetermined position, and the drive output member 4 returns back to the initial retracted position. In the direction of the rotation axis L4 of the drive output member 4, the drive receiving portion 212*b* and the driving shaft 41 may still have an overlapping region with a height of h2.

As shown in FIG. 9B, the drive receiving member 21 may protrude to be coupled to the drive output member 4, and a second position of the drive receiving member 21 is defined when the drive receiving member 21 protrudes to be coupled to the drive output member 4. By then, the drive receiving member 21 is pulled out by the actuating rod 3 along the direction d2 opposite to the direction d1.

When the drive output member 4 starts rotating, the drive receiving portion 212*b* receives the driving force. As shown in FIG. 9B, the entire drive receiving portion 212*b* enters the region formed by extending the second space S2 in a direction parallel to the mounting direction A or the disengaging direction Q. That is, in the direction from the free end of the drive receiving portion 212*b* to the supporting portion 212*a*, the entire drive receiving portion 212*b* enters the region formed by extending the second space S2 in the direction parallel to the mounting direction A or the disengaging direction Q.

Accordingly, the drive receiving member 21 may move between the first position and the second position. When the drive receiving member 21 is in the first position of retraction, during the mounting or disengaging process of the process cartridge C, the region of the drive receiving portion 212*b* with a height of h2 in a direction from the free end to the supporting portion 212*a* is located in the region formed by extending the second space S2 in the direction parallel to the mounting direction A or the disengaging direction Q. Other portions of the drive receiving portion 212*b* are in the region formed by extending the first space S1 in the direction parallel to the mounting direction A or the disengaging direction Q.

When the drive receiving member 21 is located at the second position that protrudes to be coupled to the drive output member 4, the entire drive receiving portion 212*b* enter the region formed by extending the second space S2 in a direction parallel to the mounting direction A or the disengaging direction Q. That is, in the direction from the free end of the drive receiving portion 212*b* to the supporting portion 212*a*, the drive receiving portion 212*b* is located in the region formed by extending the second space S2 in the direction parallel to the mounting direction A or disengaging direction Q.

In one embodiment, the number of the drive receiving portions 212*b* may be two, and the drive receiving portions 212*b* may extend and retract together with the drive receiving member 21 along the rotation axis L1 of the rotation member. Accordingly, the movement process of the two drive receiving portions 212*b* are the same. That is, when the drive receiving member 21 retracts, the overlapping region with a height of h2 is formed simultaneously on the two drive receiving portions 212*b*. When the drive receiving member 21 extend, the two drive receiving portions 212*b* enter the region formed by extending the second space S2 in the direction parallel to the mounting direction A or the disengaging direction Q.

As described above, according to the present disclosure, the actuating rod 3 swings in a plane defined by the longitudinal direction X and the lateral direction Y of the process cartridge C, and the initial force of the actuating rod 3 is from the cover door 6 of the apparatus. When the process cartridge C needs to be taken out, only the cover door 6 needs to be opened, and the drive receiving member 21 may return back to the initial retracted state under the effect of the tension spring 24, or under the combined effect of the tension spring 24 and the spring 14.

Further, the imaging process of the process cartridge C is fulfilled relying on a photosensitive member. The disclosed rotation member may not specifically refer to the photosensitive member, but may also be a developer roller or a primary charge roller configured around the photosensitive member. Accordingly, the drive unit D0 may be configured at at least one longitudinal end of the photosensitive member, the developer roller, and the primary charge roller directly or indirectly.

When the drive unit D0 is indirectly configured at at least one longitudinal end of the photosensitive member, the developer roller, and the primary charge roller, the drive unit D0 may be coupled to at least one of the photosensitive member, the developer roller, and the primary charge roller via an immediate gear.

In one embodiment, no sphere is mounted in the drive receiving member 21, the rotation axis of drive receiving member 21 is coaxial with the rotation axis of the rotation unit, and the drive receiving member 21 is integrated with the gear portion 25 through the connecting member 27.

Accordingly, when the process cartridge C or the rotation member are in transit, the disclosed drive receiving member 21 may not disengage with the gear portion 25 of the drive transmission device. Thus, the whole stability of the drive transmission device is guaranteed, and unfavorable situations where the end users cannot use the process cartridge due to failure of the drive transmission device may not occur.

It should be noted that, the above detailed descriptions illustrate only preferred embodiments of the present disclosure and technologies and principles applied herein. Those skilled in the art can understand that the present disclosure is not limited to the specific embodiments described herein, and numerous significant alterations, modifications and alternatives may be devised by those skilled in the art without departing from the scope of the present disclosure. Thus, although the present disclosure has been illustrated in above-described embodiments in details, the present disclosure is not limited to the above embodiments. Any equivalent or modification thereof, without departing from the spirit and principle of the present disclosure, falls within the true scope of the present disclosure, and the scope of the present disclosure is defined by the appended claims.

What is claimed is:

1. A support applicable to a process cartridge, wherein:
the process cartridge comprises a housing and a drive unit mounted in the housing;
the support is mounted on the housing;
the drive unit further comprises a drive transmission device and an actuating rod; and
the support includes a notch such that the actuating rod passes through the notch to couple to the drive transmission device.

2. The support according to claim 1, wherein:
along a mounting direction of the process cartridge, the notch is located a far side of the drive transmission device.

3. The support according to claim 2, further comprising:
a through-hole configured to allow the drive transmission device to pass through.

4. The support according to claim 3, further comprising:
a first lug and a second lug configured in a periphery of the through-hole,
wherein along a circumferential direction of the through-hole, the notch is located between the first lug and the second lug.

5. The support according to claim 4, wherein:
along the mounting direction of the process cartridge, the notch is located a far side of the first lug and the second lug.

6. The support according to claim 5, wherein:
the notch is mouth-shaped and includes a top surface and a bottom surface.

7. The support according to claim 6, wherein:
after the actuating rod is coupled to the drive transmission device, a space is formed between a bottom surface of the actuating rod and a projection of the actuating rod on the bottom surface of the notch.

8. The support according to claim 6, wherein:
after the actuating rod is coupled to the drive transmission device, a bottom surface of the actuating rod is not in contact with a projection of the actuating rod on the bottom surface of the notch.

9. The support according to claim 8, wherein:
after the actuating rod is coupled to the drive transmission device, the space is formed between the actuating rod and the projection of the actuating rod on the bottom surface of the notch, and a space is formed between the actuating rod and a projection of the actuating rod on the top surface of the notch.

10. The support according to claim 5, wherein:
the notch has a U-shaped bottom surface.

11. The support according to claim 10, wherein:
after the actuating rod is coupled to the drive transmission device, a space is formed between a bottom surface of the actuating rod and a projection of the actuating rod on the bottom surface of the notch.

12. The support according to claim 10, wherein:
after the actuating rod is coupled to the drive transmission device, a bottom surface of the actuating rod is not in contact with a projection of the actuating rod on the bottom surface of the notch.

13. The process cartridge according to claim 12, wherein:
after the actuating rod is coupled to the drive transmission device, the space is formed between the actuating rod and the projection of the actuating rod on the bottom surface of the notch, and a space is formed between the actuating rod and a projection of the actuating rod on the top surface of the notch.

14. A process cartridge, comprising:
a housing;
a drive unit mounted in the housing; and
a support,
wherein the drive unit further comprises a drive transmission device and an actuating rod, and
the support includes a notch such that the actuating rod passes through the notch to couple to the drive transmission device.

15. The process cartridge according to claim 14, wherein:
along a mounting direction of the process cartridge, the notch is located a far side of the drive transmission device.

16. The process cartridge according to claim 15, wherein:
the process cartridge is able to be detachably mounted in an apparatus comprising a drive output member, and
the drive transmission device is configured to be coupled to the drive output member to receive a driving force.

17. The process cartridge according to claim 16, wherein:
the notch is not blocked when being viewed along a rotation axis of the drive receiving member.

18. The process cartridge according to claim 17, further comprising:
a photosensitive member rotatably mounted in the housing, and
the photosensitive member includes a photosensitive cylinder.

19. The process cartridge according to claim 18, wherein:
the notch includes a bottom surface, and
the bottom surface is a surface of the notch closest to the photosensitive cylinder when viewed along the rotation axis of the drive receiving member.

* * * * *